US007515838B2

(12) United States Patent
Kadowaki et al.

(10) Patent No.: US 7,515,838 B2
(45) Date of Patent: Apr. 7, 2009

(54) DEVELOPER COLLECTING DEVICE AND IMAGE FORMING APPARATUS HAVING THE SAME

(75) Inventors: Hideaki Kadowaki, Kyoto (JP); Susumu Murakami, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 343 days.

(21) Appl. No.: 11/360,766

(22) Filed: Feb. 24, 2006

(65) Prior Publication Data

US 2006/0193648 A1 Aug. 31, 2006

(30) Foreign Application Priority Data

Feb. 25, 2005 (JP) ..... 2005-051739

(51) Int. Cl.
*G03G 15/00* (2006.01)

(52) U.S. Cl. ..... 399/13; 399/35; 399/120; 399/358; 399/360

(58) Field of Classification Search ..... 399/13, 399/35, 120, 358, 360
See application file for complete search history.

(56) References Cited

U.S. PATENT DOCUMENTS 5,260,755 A * 11/1993 Imaizumi ..... 399/35
5,893,007 A * 4/1999 Lim ..... 399/13
2004/0109704 A1* 6/2004 Abe ..... 399/107

FOREIGN PATENT DOCUMENTS

| | | |
|---|---|---|
| JP | 61-63878 | 4/1986 |
| JP | 63-146873 | 9/1988 |
| JP | 6-118844 | 4/1994 |
| JP | 2003-345203 | 12/2003 |

OTHER PUBLICATIONS

U.S. Appl. No. 11/280,411, filed Nov. 17, 2005.

* cited by examiner

*Primary Examiner*—David M Gray
*Assistant Examiner*—Ryan D Walsh
(74) *Attorney, Agent, or Firm*—Nixon & Vanderhye P.C.

(57) ABSTRACT

An electrophotographic image forming apparatus is provided with a developer collecting device which collects developer removed from an image bearing member and an intermediate transfer body by a cleaning section. The developer collecting device comprises a positioning frame for determining a mounting position of the image bearing member onto an image forming apparatus main body; a waste developer container detachably mounted on the positioning frame 4, for accommodating waste developer collected by the cleaning section; and an integrated container detection section for detecting whether or not the waste developer container is mounted on the positioning frame and whether or not the waste developer container is filled up with the waste developer.

13 Claims, 12 Drawing Sheets

DEVELOPER COLLECTING DEVICE AND IMAGE FORMING APPARATUS HAVING THE SAME

BACKGROUND

1. Field of Technology

The describe technology relates to a developer collecting device and an image forming apparatus having the developer collecting device.

2. Description of the Related Art

In recent years, it has been gradually more common in an image forming apparatus to shift printing in black and white to printing in full color. Moreover, along with development of the image forming apparatus, a color image forming apparatus has been utilized for general purposes. Among the color image forming apparatuses, especially for an image forming apparatus which employs an electrophotographic system, anindirect transfer system has been often proposed in an attempt to meet miniaturization of the apparatus and speeding up of color image formation. The indirect transfer system is characterized by the following processes in formation of a color image onto recording paper Firstly, a developer image is formed (first transfer) by stacking image information separated in color for each color component from an electrostatic latent image bearing member (hereinafter may be referred to as a photoreceptor) respectively provided on a plurality of image forming units (also referred to as a process printing unit) onto an intermediate transfer body. And then, the developer image processed by the first transfer is totally transferred (second transfer) onto the recording paper serving as a transfer-subjected medium.

In general, it is well known that, when the first transfer is carried out from a photoreceptor to an intermediate transfer body at a transfer step in the image formation, not all the developer which forms a developer image on the photoreceptor is transferred onto the intermediate transfer body, but a little developer remains on the photoreceptor. it is known that a transfer efficiency of the first transfer is approximately 90%. Also at a second transfer step for transferring the developer image on the intermediate transfer body onto the recording paper, residual developer is generated as in the above case.

Consequently, the image forming apparatus is usually provided with a cleaning device for collecting the residual developer remaining on the photoreceptor and the intermediate transfer body at the first and second transfer steps and in addition, a developer collecting device for collecting as waste developer the residual developer which has been cleaned by the cleaning device. However, in order to provide a plurality of the developer collecting devicees for a plurality of the image forming units and the intermediate transfer body, a larger space in the apparatus will be necessary therefor, which is not favorable in terms of compact design, decrease of user's operability, and pollution inside the apparatus due to the waste developer.

In consideration of the above points, the applicant has proposed an integrally-formed developer recovery container for accommodating waste developer generated from a plurality of residual developer sources in Japanese Patent Application No. 2004-335499 so as to solve the above problems. In the above proposal, integration of the container is realized, and problems about compact design or the like can be solved. However, a plurality of detecting sensors are used for determining whether or not the waste developer container is mounted on the apparatus and whether or not the waste developer container is filled up with the waste developer, so that the above proposal includes a problem of spaces necessary for mounting a plurality of detecting sensors and a problem that determination operation becomes complicated.

In a related art, a photosensor is utilized for determining whether or not a waste developer container for accommodating waste developer is present, and determining a state of the waste developer accumulated inside the waste developer container (for instance, referred to Japanese Unexamined Patent Publication JP-A 2003-345203)

In the art disclosed in JP-A 2003-345203 is provided a detecting switch which detects whether or not a waste toner box is mounted on an apparatus main body, and a photosensor which operates either in a translucent state or in a light shielding state when the detecting switch is turned on while the photosensor is brought to the same state as the translucent state when the detecting switch is turned off. When the detecting switch is turned on and the photosensor is in the light shielding state, it is determined that the waste toner box is filled up with the waste developer.

However, the art of JP-A 2003-345203 includes a problem that significantly careful check is required for the switches or the like, in order to determine whether the waste toner box is mounted and full with waste developer or the waste toner box is not mounted but a signal indicating a full state is outputted, because the photosensor is brought to the same state as the translucent state even when the detecting switch is turned off, specifically when the waste toner box is not mounted on the apparatus main body.

Further, in a method of detecting an accommodation capacity of the waste toner in the waste toner box by the photosensor, false detection may be caused since the waste toner accumulated in the container is excellent in fluidity, with the result that the waste toner contaminates an inner wall portion of the container by flowing of the waste toner inside the container, which leads decrease of detecting accuracy of the photosensor.

SUMMARY OF THE INVENTION

An object is to provide a developer collecting device having a simple configuration in which in spite of its simple configuration, detection of whether or not a waste developer container is mounted thereon and of whether or not an accomodation capacity of the waste developer container is exceeded is enabled, and enlarging the accommodation capacity of the waste developer container is realized by compact designing of a detection section in which the detections are integrated, and to provide an image forming apparatus having the developer collecting device.

A non-limiting embodiment provides a developer collecting device provided on an image forming apparatus comprising an image forming unit composed of an image bearing member on which an electrostatic latent image is formed by exposing the image bearing member to light in accordance with image information, and a developing portion for forming a developer image by developing the electrostatic latent image on the image bearing member; an intermediate transfer body onto which the developer image formed on the image bearing member is transferred; a transfer portion for totally transferring onto a transfer-subjected medium the developer image transferred on the intermediate transfer body; and a cleaning section for cleaning residual developer remaining on the image bearing member which is not transferred from the image bearing member onto the intermediate transfer body, and residual developer remaining on the intermediate transfer body which is not transferred from the intermediate transfer body onto the transfer-subjected medium, the developer collecting device which collects the developer removed from the image bearing member and the intermediate transfer body by the cleaning section, the developer collecting device comprising:

a positioning frame for determining a mounting position of the image bearing member onto an image forming apparatus main body;

a waste developer container detachably mounted on the positioning frame, for accommodating the waste developer removed by the cleaning section; and an integrated container detection section for detecting whether or not the waste developer container is mounted on the positioning frame and whether or not the waste developer container is filled up with the waste developer.

The developer collecting device comprises the integrated container detection section for detecting whether or not the waste developer container is mounted on the positioning frame and whether or not the waste developer container is filled up with the waste developer. Consequently, while the conventional detecting section requires a plurality of detecting mechanisms, in the embodiment, detection can be conducted by an integrated single detection section so that determination can be conducted by a simple control. Furthermore, the integration of the detecting section can reduce a space necessary therefor so that the waste developer container for acconunodating the waste developer can be increased in size.

Further, it is preferable that the waste developer container has a waste developer stirring shaft rotatably provided therein for stirring the waste developer accommodated therein, and the integrated container detection section is provided on a prolonged part of the waste developer stirring shaft which part is located on an outer side portion of the waste developer container mounted on the positioning frame.

Further, the waste developer container has the waste developer stirring shaft rotatably provided therein for stirring the waste developer container therein, and the container detection section is provided on the prolonged part of the waste developer stirring shaft which part is located on the outer side portion of the waste developer container. Consequently, an installation space for the container detection section is most effectively secured.

Further, it is preferable that the integrated container detection section comprises:

a movable lever angularly displaceable about a supporting shaft; and a connecting member coupled to the waste developer stirring shaft, the connecting member being movable in an axial direction according to a level of rotational load of the waste developer stirring shaft, and the integrated container detection section detects:

whether or not the waste developer container is mounted on the positioning frame in accordance with a position of the movable lever moving an angular displacement position thereof by attachment and detachment of the waste developer container with respect to the positioning frame; and whether or not the waste developer container is filled up with the waste developer in accordance with a position in the axial direction of the connecting member moving in reference to the level of rotational load of the waste developer stirring shaft.

Further, the container detection section detects whether or not the waste developer container is mounted on the positioning frame in accordance with the position of the movable lever angularly displaceable about the supporting shaft, and whether or not the waste developer container is filled up with the waste developer in accordance with the position in the axial direction of the connecting member which is coupled to the waste developer stirring shaft and movable in the axial direction according to the level of rotational load of the waste developer stirring shaft. This makes it possible to easily determine with high accuracy without false recognition whether or not the waste developer container is mounted and whether or not the waste developer container is filled up with the waste developer.

Further, it is preferable that the integrated container detection section comprises a mechanical sensor portion for detecting three different positions which are first and second positions determined in accordance with the angular displacement position of the movable lever about the supporting shaft, and a third position determined in accordance with a movement position in the axial direction of the connecting member.

Further, the container detection section comprises the mechanical sensor portion for detecting three different positions which are the first and second positions determined in accordance with the angular displacement position of the movable lever about the supporting shaft, and the third position determined in accordance with the movement position in the axial direction of the connecting member. Since the container detection section detects whether or not the waste developer container is mounted and whether or not the waste developer container is filled up with the waste developer, it becomes possible to operate accurate determination with a simple configuration.

Further At is preferable that the integrated container detection section comprises a rotary driving section; a driving coupling member coupled with the rotary driving section; and a driving arm portion mounted on the driving coupling member so as to rotate, the driving arm portion having an engaging convex portion formed thereon, and an engaging concave portion is formed on one end portion in an axial direction of the waste developer stirring shaft which one end portion faces the integrated container detection section, and by engagement of the engaging convex portion with the engaging concave portion, rotary driving force of the rotary driving section is transmitted to the waste developer stirring shaft.

Further, the rotary driving section provided on the container detection section can drive the waste developer stirring shaft of the waste developer container to rotate. Consequently, an accumulation distribution of the waste developer in the waste developer container is equalized so that the waste developer can be contained up to the limit of inner volume of the waste developer container.

Further, it is preferable that, in the integrated container detection section, the connecting member is coupled with the driving coupling member by moving in a rotational axis line direction toward the waste developer container when a rotational load of the waste developer stirring shaft is small, and the connecting member is detached from the driving coupling member by moving in the rotational axis line direction away from the waste developer container when the rotational load of the waste developer stirring shaft is large, whereby the integrated container detection section detects the third position and thereby detects that the waste developer container is filled up with the waste developer.

Further, in the container detection section, the connecting member is coupled with the driving coupling member or detached from the driving coupling member in accordance with size of the rotational load of the waste developer stirring shaft, so that the mechanical sensor portion detects the third position and thereby detects that the waste developer container is filled up with the waste developer, and therefore reliable detection with high accuracy can be achieved.

Further, it is preferable that the connecting member is provided with a spring member for biasing the connecting member against the driving coupling member.

Further, the connecting member is provided with the spring member for biasing the connecting member against the driving coupling member, so that the coupling operation or the detaching operation between the connecting member and the driving coupling member is carried out by use of elastic force of the spring member and therefore, the detection that the waste developer container is filled up with the waste developer can be achieved with a small number of members and a simple configuration.

Further, the embodiment(s) provide an image forming apparatus provided with the developer collecting device mentioned above.

Further, provision of the developer collecting device offers an image forming apparatus which enables easy and reliable detection of whether or not the waste developer container is mounted and of whether or not the waste developer container is full, and In addition which Is excellent in terms of maintenance with a larger accommodation capacity of the waste developer so that it is not necessazy to replace the waste developer containers for a long period of time.

BRIEF DESCRIPTION OF THE DRAWINGS

Other and further objects, features, and advantages of one or more embodiments of the invention will be more explicit from the following detailed description taken with reference to the drawings wherein.

DETAILED DESCRIPTION OF THE PREFERED EMBODIMENTS

Figure 1:
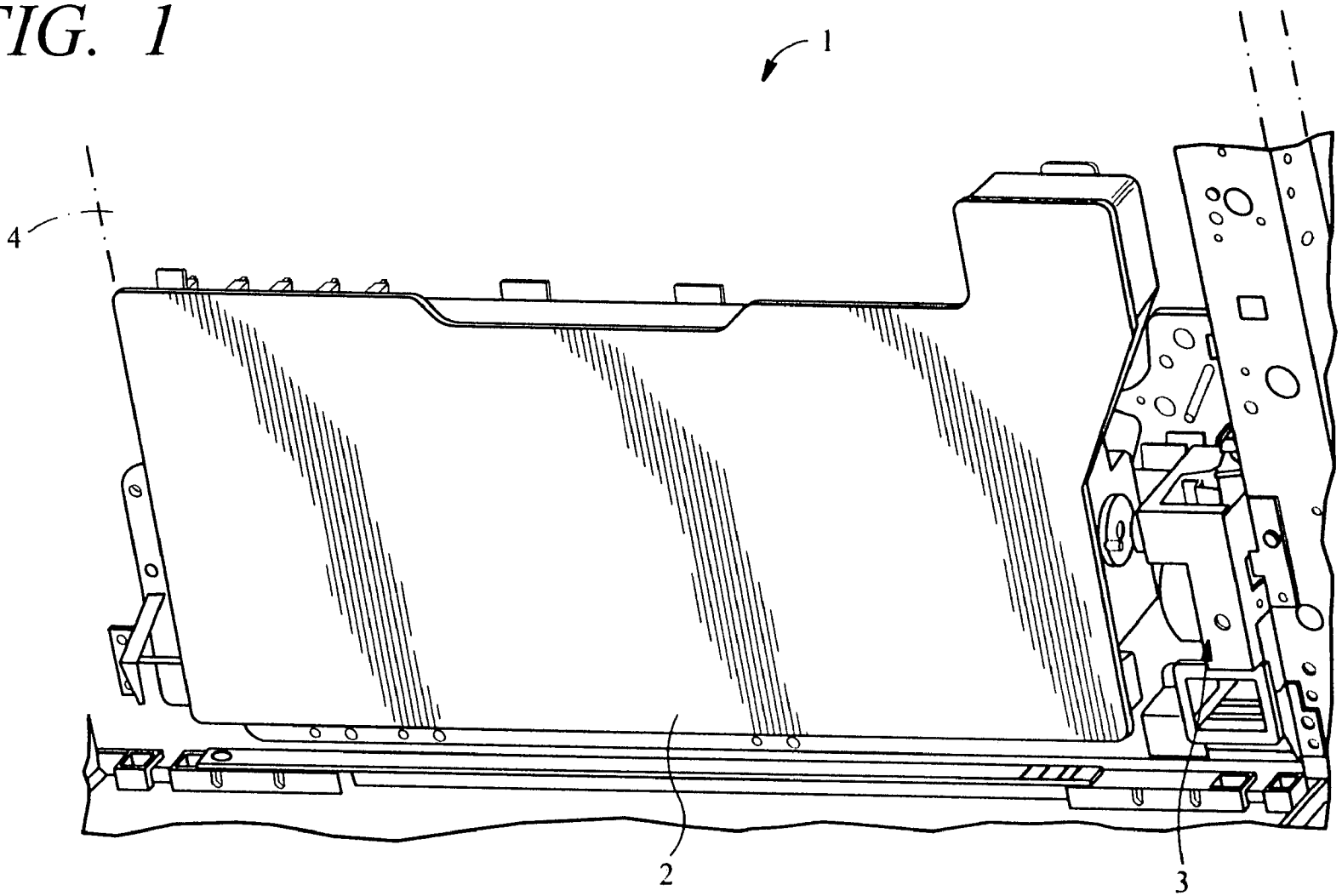
FIG. 1 is a perspective view showing an overview of a waste developer container and container detection section provided in a developer collecting device according to one embodiment of the invention.

Now referring to the drawings, preferred embodiments of the invention are described below.

Figure 2:
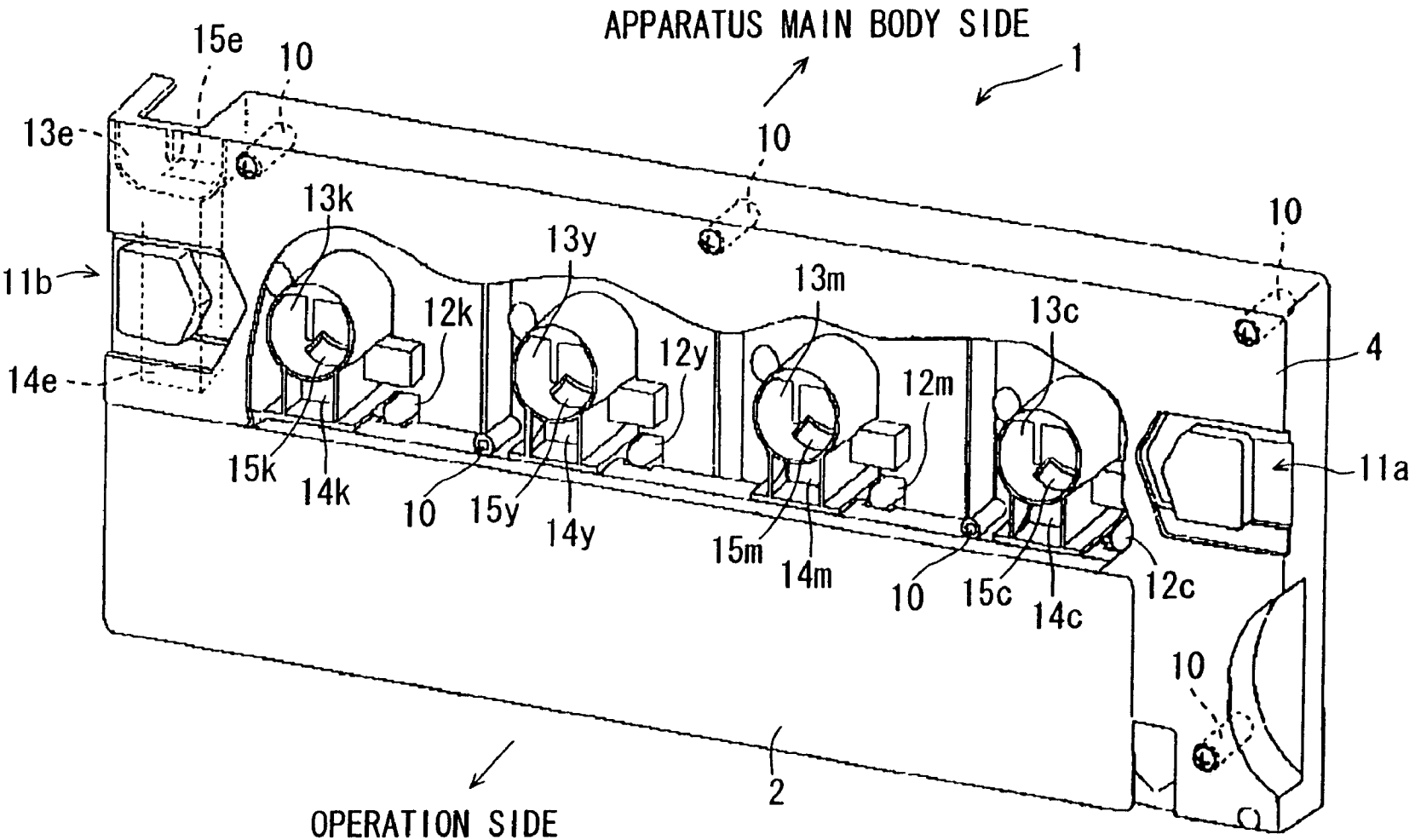
FIG. 2 is a schematic view showing a configuration of a positioning frame provided in the developer collecting device.
Figure 3:
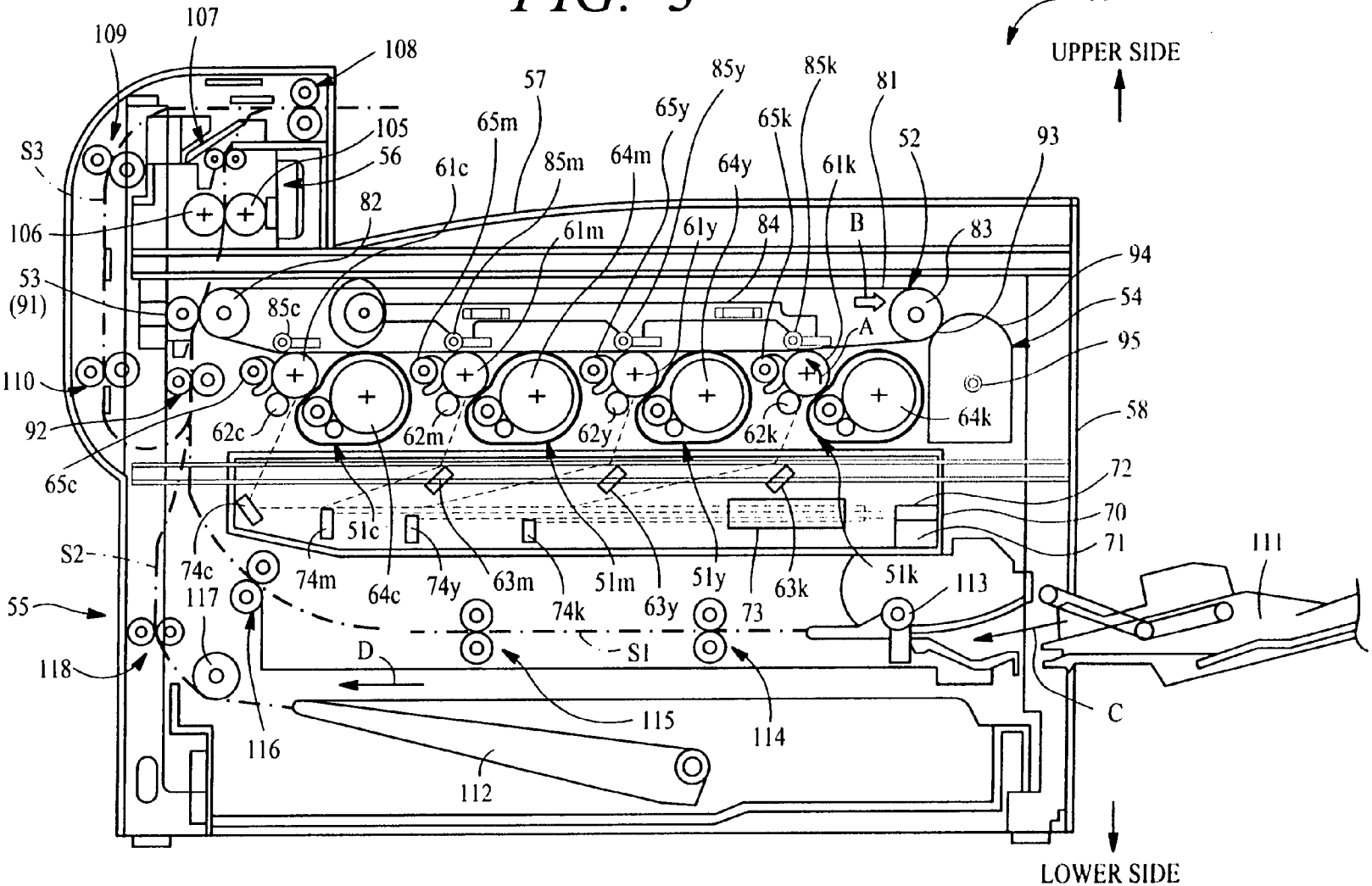
FIG. 3 is a schematic view showing a configuration of an image forming apparatus according to another embodiment of the invention, provided with the developer collecting device.

FIG. 1 is a perspective view showing an overview of a waste developer container 2 and container detection section 3 provided in a developer collecting device 1 according to one embodiment of the invention. FIG. 2 is a schematic view showing a configuration of a positioning frame 4 provided in the developer collecting device 1. FIG. 3 is a schematic view showing a configuration of an image forming apparatus 50 according to another embodiment of the invention, provided with the developer collecting device 1.

The developer collecting device 1 is provided on the image forming apparatus 50 of which detail will be described hereinbelow. The image forming apparatus 50 comprises an image forming unit 51, an intermediate transfer body 52, a transfer portion 53, and cleaning sections 54 and 65. The image forming unit 51 is provided with an image bearing member 61 on which an electrostatic latent image is formed by exposure to a light in accordance with image information, and a developing portion 64 for developing the electrostatic latent image on the image bearing member 61 into a developer image. Onto the intermediate transfer body 52 is transferred the developer image formed on the image bearing member 61. The transfer portion 53 totally transfers the developer image transferred on the image transfer body 52 onto recording paper serving as a transfer-subjected medium. The cleaning sections 54 and 65 clean residual developer remaining on the image bearing member 61 untransferred from the image bearing member 61 onto the intermediate transfer medium 52, and residual developer remaining on the intermediate transfer medium 52 untransferred from the intermediate transfer medium 52 onto the recording paper. The developer collecting device 1 collects the developer removed from the image bearing member 61 and the intermediate transfer body 52 through the cleaning sections 54 and 65. Hereinafter, the image bearing member 61 will be referred to as a photoreceptor 61.

The developer collecting device 1 comprises the positioning frame 4, the waste developer container 2, and the container detection section 3. The positioning frame 4 determines a position at which the photoreceptor 61 is mounted in a case 58 serving as an image forming apparatus main body. The waste developer container 2 is detachably mounted on the positioning frame 4 so that the waste developer removed by the cleaning sections 54 and 65 is accommodated in the waste developer container 2. The container detection section 3 detects whether or not the waste developer container 2 is mounted on the positioning frame 4 and whether or not the waste developer container 2 is filled with the waste developer. Constitutions for these detections are integrated in the container detection section 3. Accordingly, an integrated container detection section of the invention is realized by the container detection section 3.

The positioning frame 4 has a shape of long box extending along the image forming unit 51 and the inter mediate transfer body 52 provided in the image forming apparatus 50. The positioning frame 4 is formed of, for instance, hard synthetic resin. From behind the image forming apparatus 50 in a sheet of FIG. 3 showing the image forming apparatus 50 (hereinafter referred to as an operation side), the positioning frame 4 is mounted on the case 58.

Figure 4:
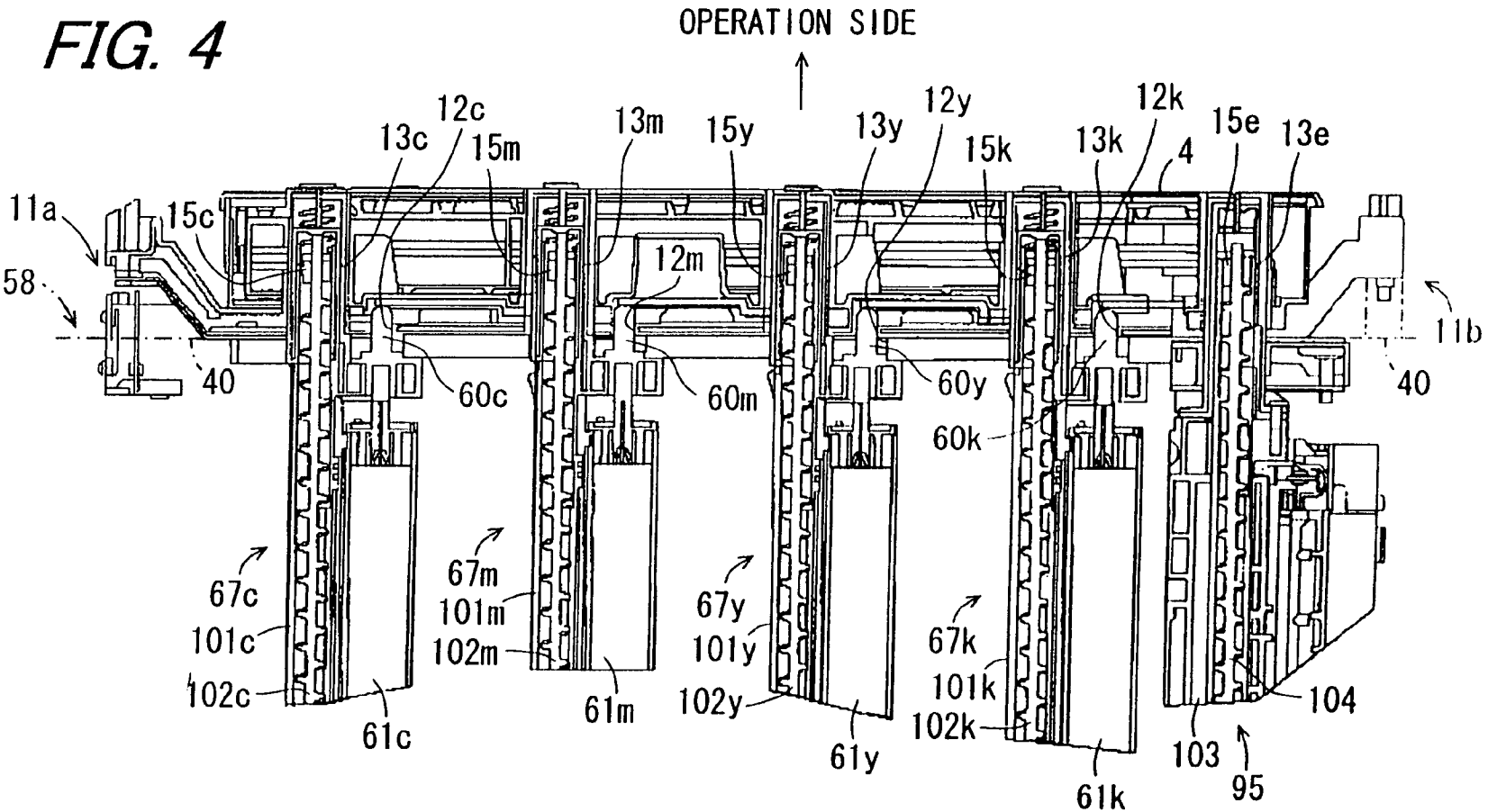
FIG. 4 is a longitudinal sectional view showing photoreceptors positioned by the positioning frame.

FIG. 4 is a longitudinal sectional view showing the photoreceptor 61 positioned by the positioning frame 4. Both end portions in the longitudinal direction (hereinafter referred to as a horizontal width direction) of the positioning frame 4 are provided with case-position positioning members 11*a* and 11*b* for positioning the case 58.

The case-position positioning members 11*a* and 11*b* have support function for supporting the positioning frame 4 when mounting the positioning frame 4 on the case 58. The positioning frame 4 is positioned on the case 58 in such a manner that the positioning frame 4 is positioned on a mounting face 40 of the case 58 by the case-position positioning members 11*a* and 11*b*. Positioning between the case-position positioning members 11*a*, 11*b* and the case is achieved by the following method. The positioning frame 4 is provided with positioning components such as a positioning pin, a positioning block, and a wedge-shaped fit, which components can be protruded therefrom. The case 58 is provided with an engaging member for engaging with the positioning component. The positioning component on the positioning frame 4 and the engaging member on the case 58 are made to be engaged with each other so that vertical and horizontal directions of the positioning frame 4 and case 58 are respectively positioned.

The positioning frame 4 has photoreceptor shaft support holes 12*k*, 12*y*, 12*m*, and 12*c*, each of which is formed at a portion corresponding to one end portion of a photoreceptor shaft 60*k*, 60*y*, 60*m*, and 60*c* in the photoreceptor 61*k*, 601*y*, 61*m*, and 61*c* of each of plural image forming units 51 provided in the image forming apparatus 50. The photoreceptor shaft support holes 12*k*, 12*y*, 12*m*, and 12*c* respectively engage with one end portion of each of photoreceptor shafts 60*k*, 60*y*, 60*m*, and 60*c*.

Moreover, photoreceptor cleaning sections 65*k*, 65*y*, 65*m*, and 65*c* serving as cleaning means on each of the image forming units 51 are respectively provided with photoreceptor waste toner conveying devices 67*k*, 67*y*, 67*m*, and 67*c*. The positioning frame 4 has waste developer recovery ports 13*k*, 13*y*, 13*m*, and 13*c*, each of which is formed at a portion corresponding to one end portion of each of the photoreceptor waste toner conveying devices 67*k*, 67*y*, 67*m*, and 67*c*. The waste developer recovery ports 13*k*, 13*y*, 13*m*, and 13*c* are positioned by respectively engaging with the one end portion of each of the photoreceptor waste toner conveying devices 67*k*, 67*y*, 67*m*, 67*c*. The transfer cleaning device 54 serving as a cleaning section provided on the intermediate transfer body 52 is provided with a transfer body waste toner conveying device 95. The positioning frame 4 has a waste developer recovery port 13*e* which is formed at a portion corresponding to one end portion of the transfer body waste toner conveying device 95. The waste developer recovery port 13*e* is positioned by engaging with the one end portion of the transfer body waste toner conveying device 95.

Below the waste developer recovery ports 13*k*, 13*y*, 13*m*, 13*c*, and 13*e* are formed waste developer passages 14*k*, 14*y*, 14*m*, 14*c*, and 14*e* which passages eventually lead to the waste developer container 2 the waste developer conveyed by the photoreceptor waste toner conveying devices 67*k*, 67*y*, 67*m*, 67*c*, and transfer body waste toner conveying device 95. Through each of waste developer passing holes 15*k*, 15*y*, 15*m*, 15*c*, and 15*e*, communication is obtained respectively between the waste developer recovery ports 13*k*, 13*y*, 13*m*, 13*c*, and 13*e* and the waste developer passages 14*k*, 14*y*, 14*m*, 14*c*, and 14*e*.

In other words, the residual developer (waste developer) removed from surfaces of the photoreceptor 61 and intermediate transfer body 52 by the photoreceptor cleaning sections 65*k*, 65*y*, 65*m*, 65*c*, and transfer body cleaning section 54 is sequentially conveyed with the assistance of the photoreceptor waste toner conveying devices 67*k*, 67*y*, 67*m*, 67*c*, and transfer body waste toner conveying device 95, to the waste developer container 2 in which the developer is to be collected, by way of the waste developer recovery ports 13*k*, 13*y*, 13*m*, 13*c*, and 13*e* of the positioning frame 4 and the waste developer passing holes 15*k*, 15*y*, 15*m*, 15*c*, and 15*e*, and furthermore the waste developer passages 14*k*, 14*y*, 14*m*, 14*c*, and 14*e*.

This positioning frame 4 is, after positioned by the case positioning members 11*a* and 11*b*, mounted on the case 58 by screw, bolt, or the like at a mounting portion 10 situated close to corner portions and side ends of the flame.

Figure 5:
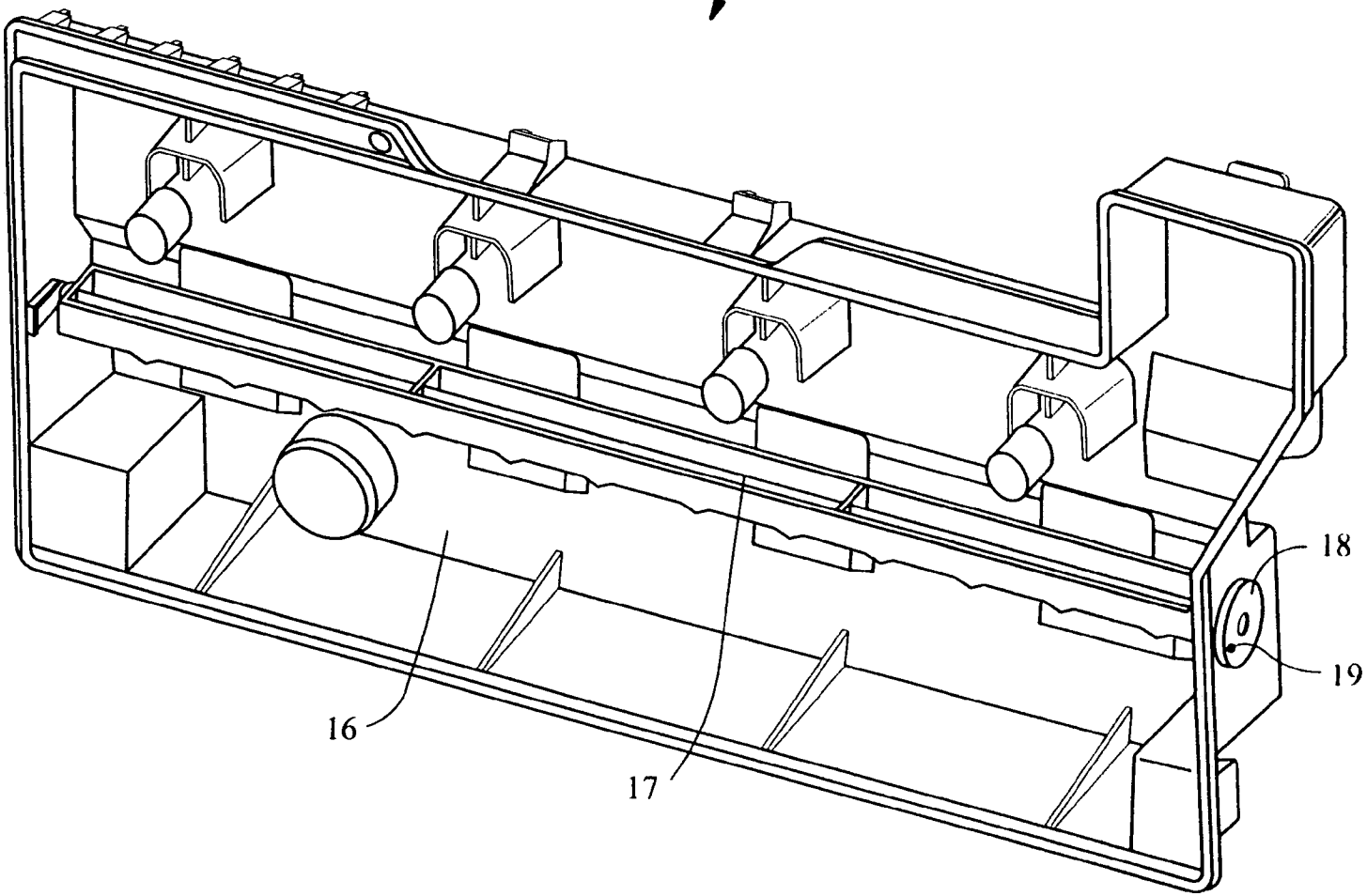
FIG. 5 is a view showing an internal configuration of the waste developer container.

The waste developer container 2 is detachably mounted on the lower part of the positioning frame 4. FIG. 5 is a view showing an internal configuration of the waste developer container 2. The waste developer container 2 is formed of, for instance, hard synthetic resin. A shape of the waste developer container 2 is a hollow rectangular parallelepiped extending in the horizontal width direction. An internal space 16 of the waste developer container 2 is provided with a waste developer stirring shaft 17 extending in the horizontal width direction, for stirring the waste developer accommodated in the internal space 16. The waste developer stirring shaft 17 is rotatably supported by the waste developer container 2. On one end portion of the waste developer stirring shaft 17 supported by the waste developer container 2 is coupled a rotating terminal 18 serving as a member for transmitting rotary driving force to outside of the container via a side wall of the waste developer container 2. The rotating terminal 18 has an engaging concave portion 19 formed at a position decentered from a shaft center of the waste developer stirring shaft 17.

Figure 6:
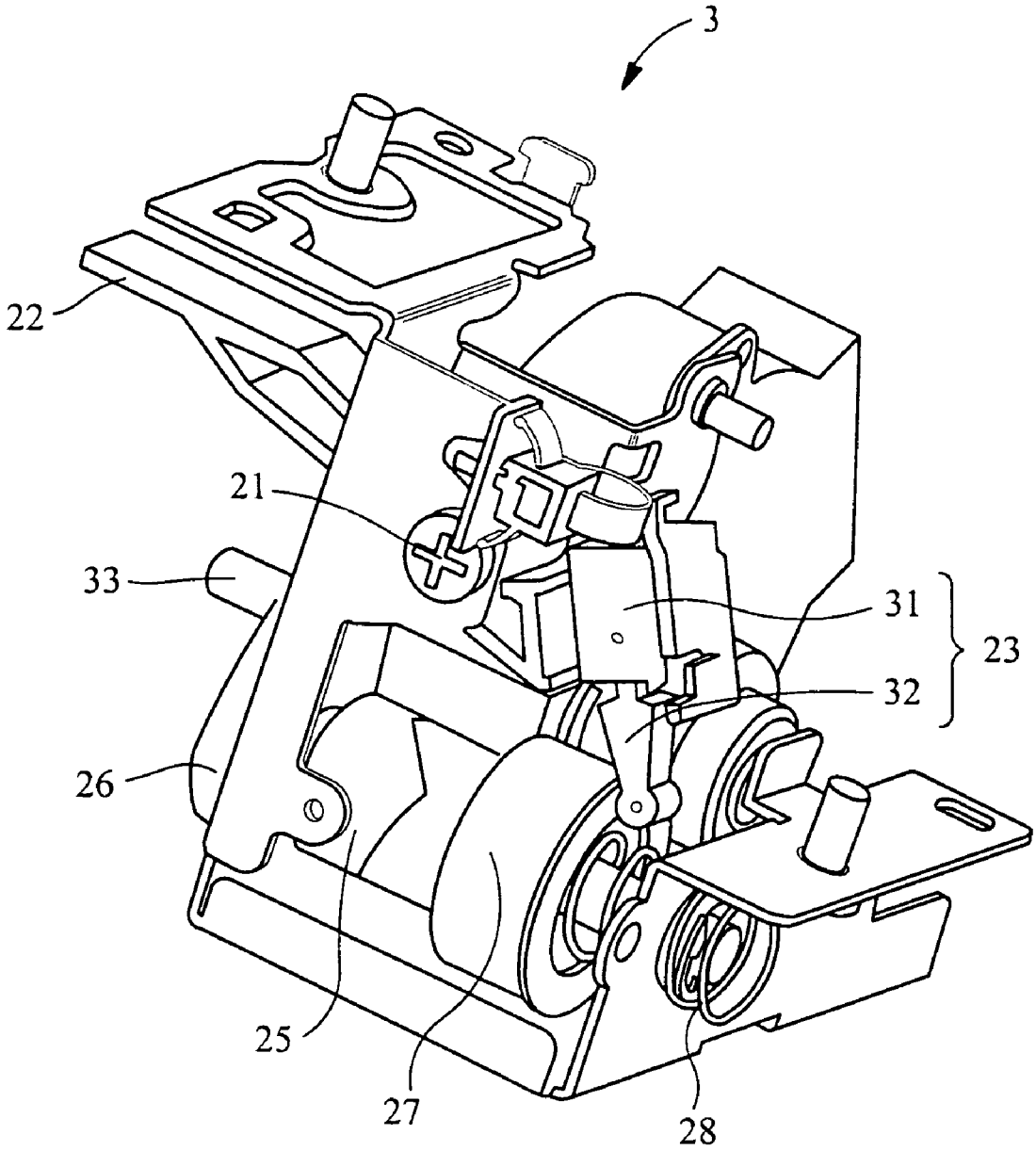
FIG. 6 is a perspective view showing the container detection section seen from above.
Figure 7:
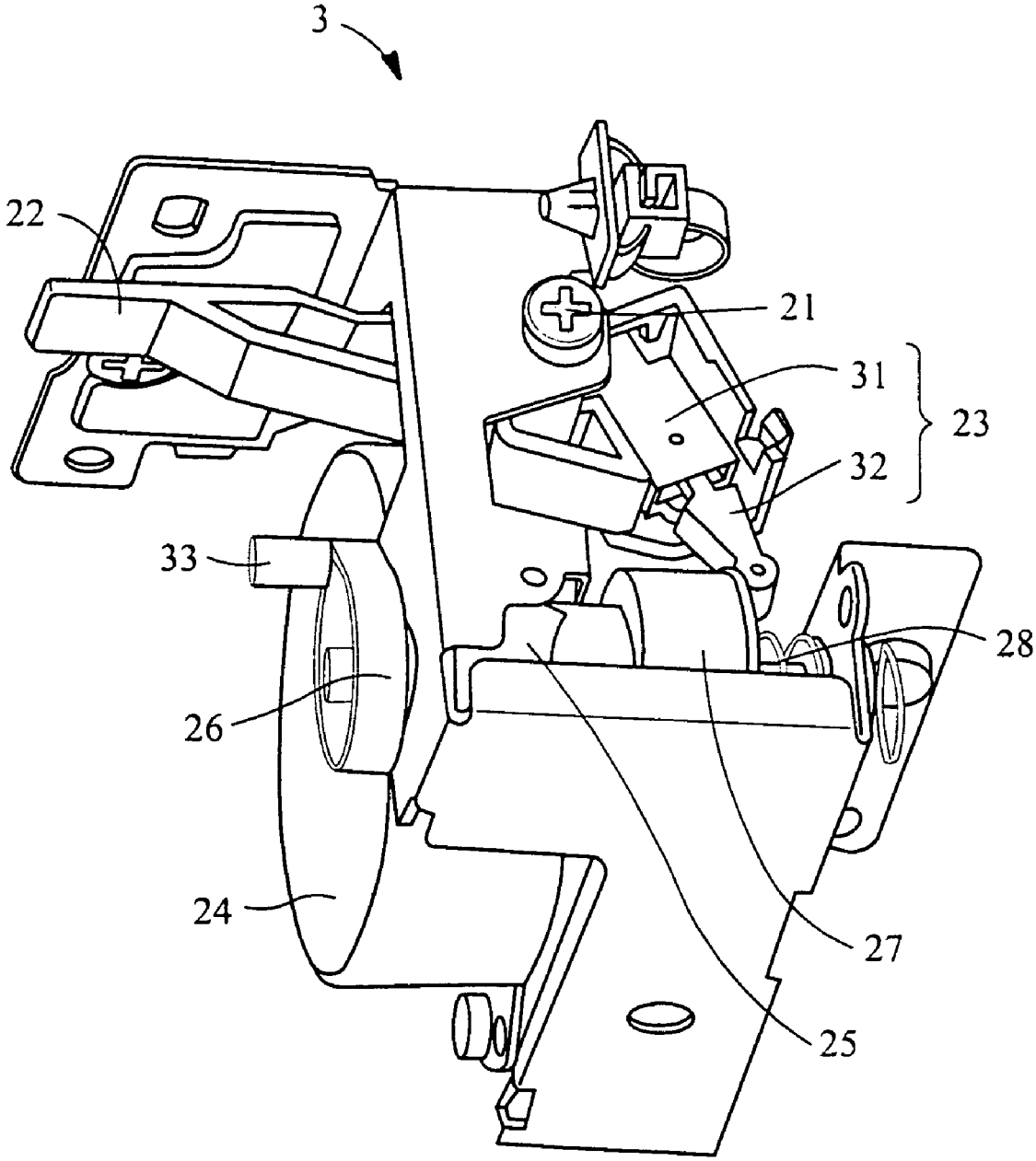
FIG. 7 is a perspective view showing the container detection section seen from beneath.

The container detection section 3 is provided on a prolonged part of the waste developer stirring shaft 17 which part is located on an outer side portion of the waste developer container 2 mounted on the positioning frame 4. FIG. 6 is a perspective view showing the container detection section 3 seen from above. FIG. 7 is a perspective view showing the container detection section. 3 seen from beneath.

The container detection section 3 comprises a movable lever 22, a mechanical sensor portion 23, a rotary driving section 24, a driving coupling member 25, a driving arm portion 26, a connecting member 27, and a spring member 28. The movable lever 22 is provided so as to be angularly displaceable about a supporting shaft 21. The mechanical sensor portion 23 is integrally provided on the movable lever 22. The driving coupling member 25 is coupled on the rotary driving section 24. The driving arm portion 26 is mounted on the driving coupling member 25 so as to rotate. The connecting member 27 is freely coupled on and detached from the driving coupling member 25. The spring member 28 biases the connecting member 27 against the driving coupling member 25.

The mechanical sensor portion 23 comprises: a sensor main body portion 31; and a sensor arm portion 32 fitted on the sensor main body portion 31 so as to be angularly displaceable to three different predetermined positions. The mechanical sensor portion 23 is configured integrally with the movable lever 22 so that the mechanical sensor portion 23 moves to different positions in accordance with angular displacement of the movable lever 22 about the supporting shaft 21. Furthermore, the sensor arm portion 32 can be at three different positions with respect to the sensor main body portion 31.

The rotary driving section 24 is, for instance, an electric motor. The driving coupling member 25 is coupled on the rotary driving section 24 via a train of gears or the like. The driving coupling member 25 is a so-called coupling which transmits rotary driving force of the electric motor 24. The driving arm portion 26 is coupled on a side of the driving coupling member 25 which side faces the waste developer container 2. On this driving arm portion 26 is formed an engaging convex portion 33 at a position which corresponds to the above-descried engaging concave portion 19 of the rotating terminal 18 mounted on one end portion of the waste developer stirring shaft 17. The engaging concave portion 19 of the rotating terminal 18 and the engaging convex portion 33 of the driving arm portion 26 are engaged with each other so that the rotary driving force of the electric motor 24 is transmitted to the waste developer stirring shaft 17 through the driving coupling member 25, with the result that the waste developer contained in the internal space 16 of the waste developer container 2 is stirred.

Meanwhile, a side of the driving coupling member 25, opposite to the side on which the driving arm portion 26 is coupled, is formed into a zigzag in a circumferential direction. Moreover, the connecting member 27 and the driving coupling member 25 share a shaft center and in addition, a side of the connecting member 27 which side faces the driving coupling member 25, is formed into such a zigzag in circumferential direction that corresponds to the zigzag of the driving coupling member 25. Since the spring member 28 biases the connecting member 27 against the driving coupling member 25 as described above, during normal operation, the connecting member 27 rotates together with the driving coupling member 25 while zigzag portions thereof are engaged with each other.

However, when the waste developer accommodated in the waste developer container 2 increases, the waste developer stirring shaft 17 has a larger rotational load, so that the driving coupling member 25 coupled on the waste developer stirring shaft 17 has a higher rotation torque. When the rotation torque of the driving coupling member 25 becomes higher, a biasing force of the spring member 28 for basing the connecting member 27 against the driving coupling member 25 falls below the rotation torque, with the result that the driving coupling member 25 and the connecting member 27 slip against each other at the zigzag portions. Consequently, when the rotational load of the waste developer stirring shaft 17 is small, the connecting member 27 moves in a rotational axis line direction toward the waste developer container 2 so as to be coupled on the driving coupling member 25 at the zigzag portions. In contrast, when the rotational load of the waste developer stirring shaft 17 is large, the connecting member 27 moves in the rotational axis line direction away from the waste developer container 2 so as to be detached from the driving coupling member 25.

Figure 8A:
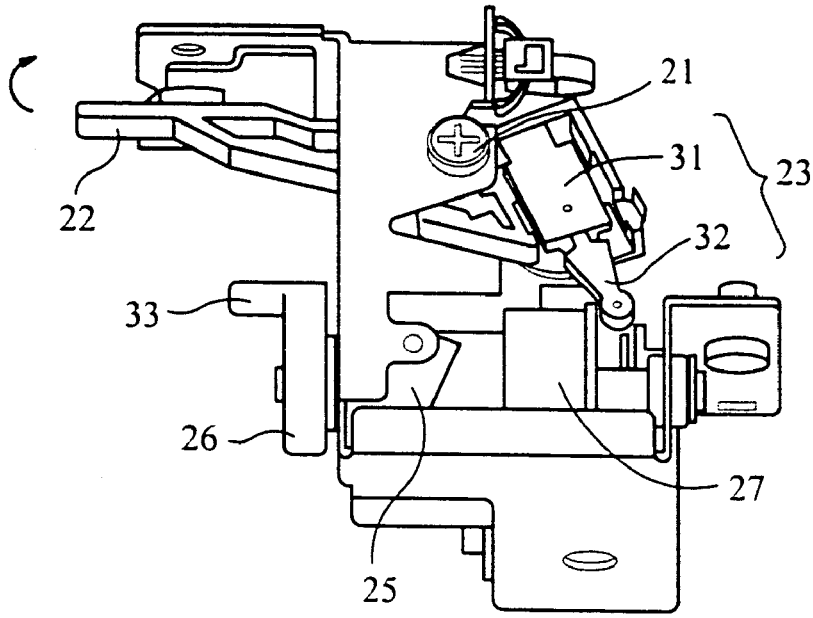
FIGS. 8A to 8C are views of assistance in explaining an outline of detecting operation of the container detection section.
Figure 8B:
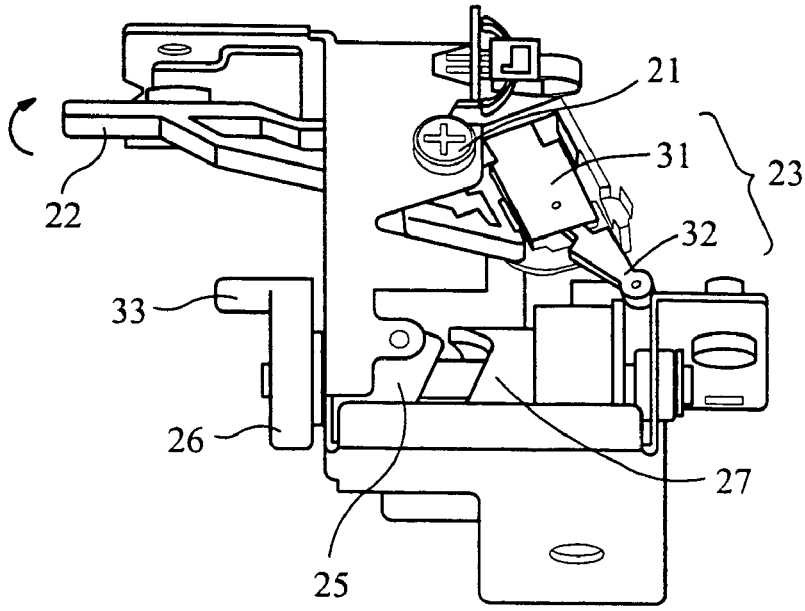
Figure 8C:
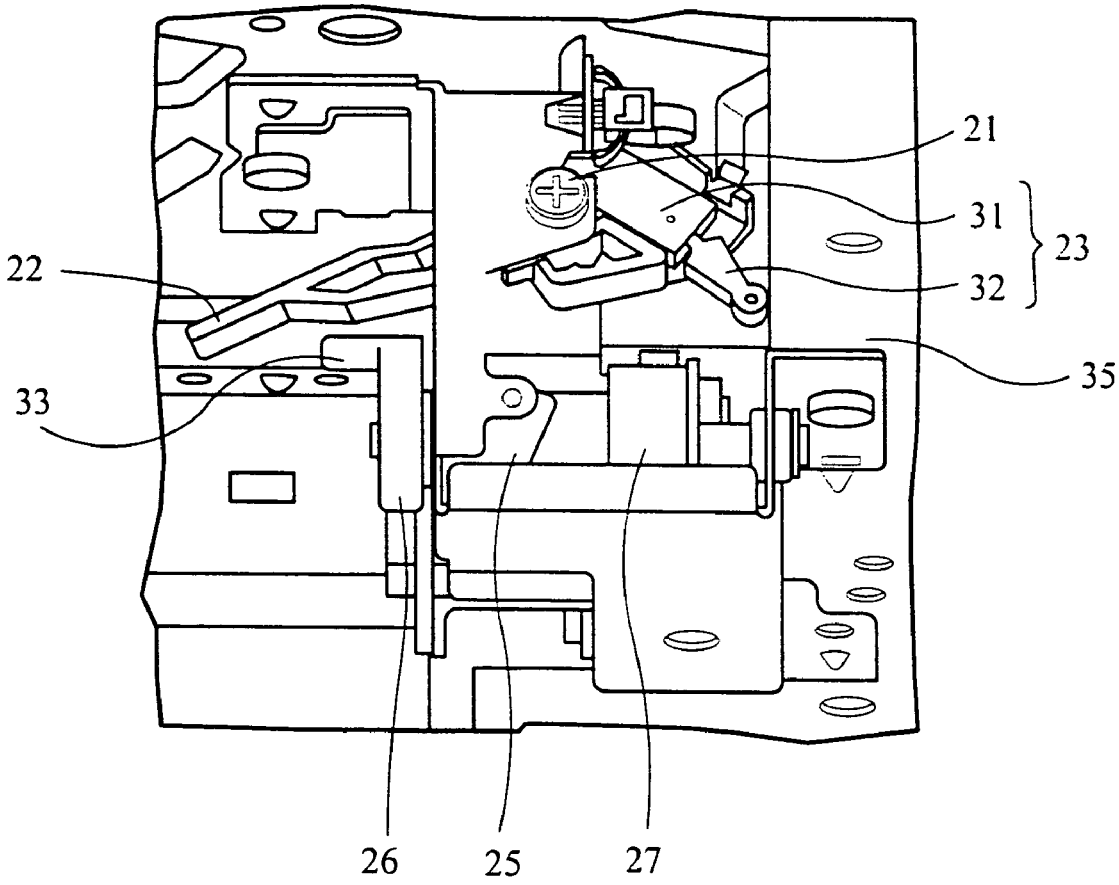
Figure 9:
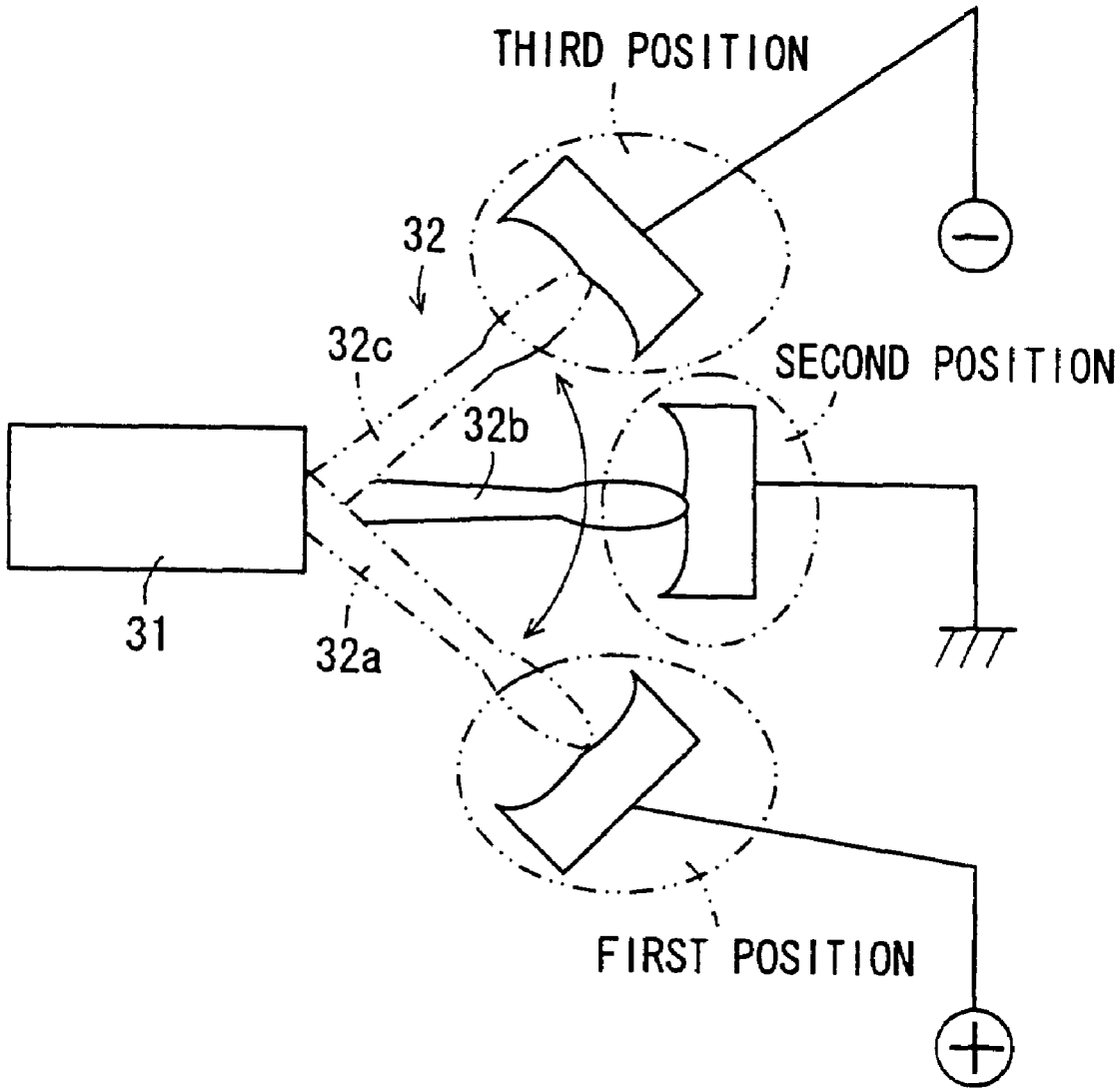
FIG. 9 is a view of assistance in explaining an outline of operation of a mechanical sensor portion.

Hereinafter will be described an operation, in the container detection section 3, for detecting whether or not the waste developer container 2 is mounted on the positioning frame 4. FIGS. 8A to 8C are views of assistance in explaining an outline of detecting operation of the container detection section 3. FIG. 9 is a view of assistance in explaining an outline of operation of the mechanical sensor portion 23.

FIG. 8C shows the container detection section 3 in a state where the waste developer container 2 is detached from the positioning frame 4. When the waste developer container 2 is not mounted on the positioning frame 4, the movable lever 22 is situated downward at an angularly displaced position whilst the mechanical sensor portion 23 is situated upward, in contrast to the case of the movable lever 22, at an angularly displaced position about the supporting shaft 21. Although the mechanical sensor portion 23 moves upward, the sensor arm portion 32 of the mechanical sensor portion 23 is prevented from being angularly displaced by a tip thereof abutted on a frame body 35 of the positioning frame 4 on which the container detection section 3 is mounted, with the result that the sensor arm portion 32 is situated at a first position depicted by a sensor arm portion 32a in FIG. 9 which first position is the relatively lowest position with respect to the sensor main body portion 31.

FIG. 8A shows the container detection section 3 in a state where the waste developer container 2 is mounted on the positioning frame 4. When the waste developer container 2 is mounted on the positioning frame 4, the movable lever 22 is situated upward at an angularly displaced position whilst the mechanical sensor portion 23 is situated downward, in contrast to the case of the movable lever 22, at an angularly displaced position about the supporting shaft 21. Since the mechanical sensor portion 23 moves downward, the tip of the sensor arm portion 32 of the mechanical sensor portion 23 is away from the frame body 35 of the positioning frame 4 on which the container detection section 3 is mounted, with the result that the sensor arm portion 32 is situated at a second position depicted by a sensor arm portion 32*b* in FIG. 9 which second position is a relatively neutral position with respect to the sensor main body portion 31.

The container detection section 3 thus detects whether or not the waste developer container 2 is mounted on the positioning frame 4, depending on whether the sensor arm portion 32 is situated at the first position or at the second position, a relative position of which sensor arm portion 32 is made to change with respect to the sensor main body portion 31 in accordance with the position of the movable lever 22 moving an angular displacement position thereof by attachment and detachment of the waste developer container 2 with respect to the positioning frame 4. In other words, when the movable lever 22 is located below and the sensor arm portion 32 is located at the first position, it is detected that the waste developer container 2 is not mounted on the positioning frame 4. In contrast, when the movable lever 22 is located above and the sensor arm portion 32 is located at the second position, it is detected that the waste developer container 2 is mounted on the positioning frame 4. Note that a detected result through the container detection section 3 is inputted into a control section (not shown) provided in the image forming apparatus 50.

In a state where the waste developer container 2 is mounted on the positioning frame 4, an image forming step is carried out in the image forming apparatus 50. During repeated executions of the image forming step, into the waste developer container 2 is conveyed the residual developer (waste developer) removed from the surfaces of photoreceptor 61 and intermediate transfer body 52 by the photoreceptor cleaning sections 65*k*, 65*y*, 65*m*, 65*c*, and transfer body cleaning section 54, by means of the photoreceptor waste toner conveying devices 67*k*, 67*y*, 67*m*, 67*c*, and transfer body waste toner conveying device 95.

When an amount of the waste developer accommodated in the waste developer container 2 is small so that the waste developer stirring shaft 17 has a small rotational load, the driving coupling member 25 and the connecting member 27 are coupled on each other at the zigzag portions, and the connecting member 27 is located in the rotational axis line direction closer to the waste developer container 2. Meanwhile, the amount of the waste developer accommodated in the waste developer container 2 is large so that the waste developer stirring shaft 17 has a large rotational load, the biasing force of the spring member 28 falls below the rotational load of the driving coupling member 25, with the result that the driving coupling member 25 and the connecting member 27 slip against each other at the zigzag portions so as to be separated away from each other and then, the connecting member 27 moves in the rotational axis line direction away from the waste developer container 2.

FIG. 8B shows the waste developer container 2 filled up with the waste developer in a state where the waste developer container 2 is mounted on the positioning frame 4. When the waste developer container 2 is filled up with the waste developer, in other words, when the rotational load of the waste developer stirring shaft 17 increases, the connecting member 27 pushes the sensor arm portion 32 so that the sensor arm portion 32 is made to be angularly displaced relatively with respect to the sensor main body portion 31, with the result that the sensor arm portion 32 is situated at a third position depicted by a sensor arm portion 32*c* in FIG. 9 which third position is the relatively highest position with respect to the sensor main body portion 31. In other words, the container detection section 3 detects that the sensor arm portion 32 is located at the third position which sensor arm portion 32 is angularly displaced in accordance with a position in an axial direction of the connecting member 27 moving in reference to a level of the rotational load of the waste developer stirring shaft 17 when the waste developer accommodated in the waste developer container 2 increases. By so doing, the container detection section 3 detects that the waste developer container 2 is filled up with the waste developer. Note that this detected result through the container detection section 3, indicating that the waste developer container 2 is full, is also inputted into the above-described control section.

Accordingly, the container detection section 3 is capable of detecting whether or not the waste developer container 2 is mounted on the positioning frame 4 and whether or not the waste developer container 2 is filled up with the waste developer, by means of the mechanical sensor portion 23 for detecting three different positions among the first and second positions determined in accordance with the angular displacement position of the movable lever 22 about the supporting shaft 21, and the third position determined in accordance with a movement position in the axial direction of the connecting member 27.

As described above, it becomes possible to detect whether or not the waste developer container 2 is mounted, and whether or not in the waste developer container 2 is filled up with the waste developer, through a state variation of a single container detection section 3. Consequently, in comparison with a case where a plurality of detecting sensors are used for detection and control, a control circuit can be simplified, and the waste developer container can be of higher capacity in the apparatus. Furthermore, the detection can be carried out by the single detecting section and therefore, it is possible to achieve enhancement of detecting accuracy, and various problems are solved such as dispersal of the developer in the apparatus, caused by malfunction of the detecting section, locked phenomenon of the waste developer stirring shaft, locking (breakdown) of the cleaning device disposed between the photoreceptor and the intermediate transfer body, scratches on the photoreceptor and the intermediate transfer body, decrease in image (print) quality, and the like.

Next, with reference back to FIG. 3, the image forming apparatus 50 serving as another embodiment of the invention will be described. The image forming apparatus 50 comprises a plurality of image forming units 51, an intermediate transfer body 52, a transfer portion 53, a photoreceptor cleaning device 65, a transfer body cleaning device 54, a developer collecting device 1 a feeding portion 55, a fixing portion 56, a discharging portion 57, and a conveyance system. A plurality of the image forming units 51 are provided with photoreceptors 61 on which electrostatic latent images are formed by exposure to a light in accordance with image information separated in color, and developing portions 64 for developing the electrostatic latent images on the photoreceptors 61 into developer images. On the intermediate transfer body 52 are stacked a plurality of the developer images formed on the photoreceptors 61 so that the developer images are transferred onto the intermediate transfer body 52. The transfer portion 53 totally transfers the developer image transferred on the image transfer body 52 onto recording paper serving as a transfer-subjected medium. The cleaning device 65 cleans residual developer remaining on the photoreceptors 61 untransferred from the photoreceptors 61 onto the intermediate transfer medium 52. The transfer body cleaning device 54 cleans residual developer remaining on the intermediate transfer medium 52 untransferred from the intermediate transfer medium 52 onto the recording paper. The developer collecting device 1 collects the developer (waste developer) cleaned away through the photoreceptor cleaning device 65 and the transfer body cleaning device 54. The feeding portion 55 supplies the recording papers. The fixing portion 56 fixes the developer image transferred onto the recording paper. The discharging portion 57 discharges the recording paper on which the developer image has been fixed. Through the conveyance system, the recording paper is conveyed inside the apparatus main body.

This image forming apparatus 50 is, for instance, a digital color printer. By the image forming apparatus 50, a full-color image or a black-and-white image is formed on recording paper, on the basis of a print job from information processors such as an externally-connected personal computer.

The image forming apparatus 50 shown in FIG. 3 is disposed so that an operator operates the apparatus from behind the sheet of FIG. 3. Accordingly, in a case where the operator faces the image forming apparatus 50 for operation, right and left in a horizontal direction are opposite to those in a case where the image forming apparatus 50 is seen from an anterior view of FIG. 3.

Hereinafter will be described each portion of the image forming apparatus 50.

The image forming apparatus 50 according to the embodiment is a full-color image forming apparatus. The image forming unit 51 for forming an image for each color component by separating the image information in color is provided so as to correspond to four color components of black (k), yellow (y), magenta (m), and cyan (c). The four image forming units 51 are different only in color thereof, with the same configuration. Accordingly, an image forming unit 51*k* for black (k) will be described as a representative example of the configuration so as to omit descriptions of the image forming units 51 for the other color components. Note that, with regard to the image forming unit 51, the photoreceptor cleaning device 65, or the like which is provided for each color component, an alphabet indicating a color component is given herein to each element after a reference numeral thereof while only reference numeral is given in a case where the elements are collectively referred.

Figure 10:
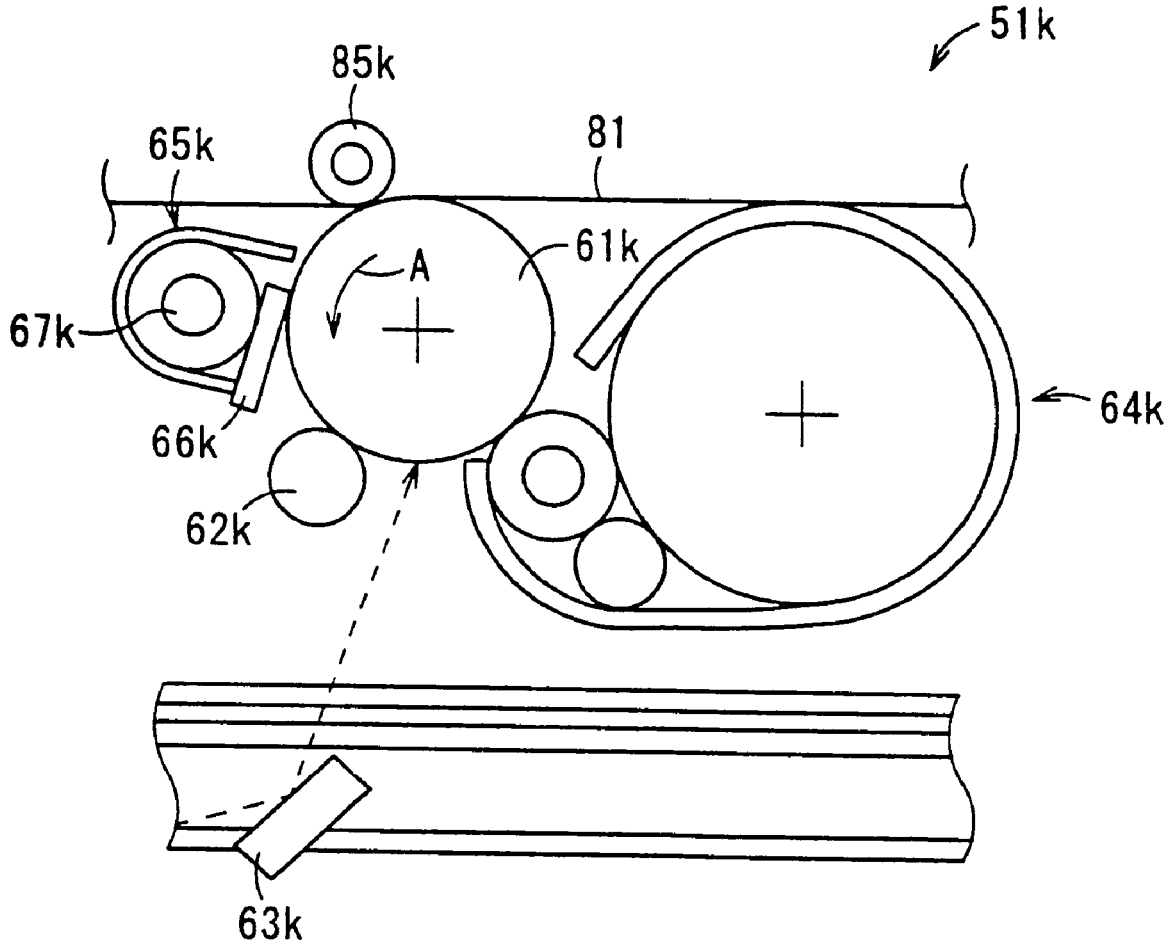
FIG. 10 is an enlarged view showing an image forming unit.

FIG. 10 is an enlarged view showing the image forming unit 51*k*. The image forming unit 51*k* comprises a photoreceptor 61*k*, a charger 62*k*, an exposure portion 63*k*, a developing portion 64*k*, and a photoreceptor cleaning device 65*k* serving as a cleaning section. The photoreceptor 61*k* has a drum shape. An electrostatic latent image is formed on a surface of the photoreceptor 61*k*. The charger 62*k*, the exposure portion 63*k*, the developing portion 64*k*, and the photoreceptor cleaning device 65*k* are disposed from an upstream side toward a downstream side in a rotation direction along an outer periphery of the photoreceptor 61*k* rotating in an arrow sign A direction. The exposure portion 63*k* irradiates the photoreceptor 61*k* with a light emitted from an exposure unit 70.

The charger 62*k* uniformly charges the surface of the photoreceptor 61*k*. In the embodiment, a roller charger is disposed in contact with an outer peripheral face of the photoreceptor 61*k*. Note that the charger is not limited to the roller charger, but a brush charger, a charger type charger, or the like may be used, for instance.

The exposure portion 63*k* irradiates the uniformly charged surface of the photoreceptor 61*k* with a light in accordance with image information of a black color component so that an electrostatic latent image of black is formed. The exposure portion 63*k* is, as well as the exposure portions 63 of the other color components, a part of the exposure unit 70. The exposure unit 70 produces an electrostatic latent image by irradiating each photoreceptor 61 with a laser light for each color component on the basis of the image information used for image formation. The exposure unit 70 comprises a laser scanning unit (abbreviated as LSU) 72 provided with a laser irradiating portion 71; a polygon mirror 73; and first reflecting mirror 74 and second reflecting mirror 63 for reflecting the laser light for each color component. The exposure portion 63 in the respective image forming unit 51 should be shown as a whole exposure unit 70 to be precise, but on showing a placement on the outer periphery of the photoreceptor 61, the second reflecting mirror 63 is referred to as the exposure portion 63 for the sake of convenience. The laser light emitted from the laser irradiating portion 71 is reflected on the exposure portion which indicates the first reflecting mirror 74 and the second reflecting mirror 63, via the polygon mirror 73 and then, the photoreceptor 61 for each color component is irradiated with the laser light. Note that LSU 72 may be configured so that, instead of the laser irradiating portion 71, a writing head is used in which light emitting elements such as EL (electro luminescence) and LED (light emitting diode) are arranged in an array.

The developing portion 64*k* supplies a toner, which is developer of black, to the electrostatic latent image formed on the surface of the photoreceptor 61*k* so that an image is developed. The photoreceptor cleaning device 65*k* is disposed upstream of the charger 62*k* with respect to the rotation direction shown by the arrow sign A of the photoreceptor 61*k*. The photoreceptor cleaning device 65*k* comprises a cleaning blade 66*k* and a photoreceptor waste toner conveying device 67*k*. The cleaning blade 66*k* is disposed on the outer peripheral face of the photoreceptor 61*k* in abutment therewith so as to scrub off the remaining developer from the surface of the photoreceptor 61*k*, which developer has not been transferred onto the intermediate transfer body 52, The photoreceptor waste toner conveying device 67*k* conveys the developer, which has been scrubbed off by the cleaning blade 66*k*, namely the waste toner, to the waste developer reeoveiy port 13 of the developer collecting device 1.

Note that, among the developer, basically a toner is supplied onto the photoreceptors 61 and therefore, the developer and the toner will be used in the same meaning after the developer moves to the photoreceptors 61.

In thus configured image forming units 51, in the embodiment, the image forming unit 51*k* for black is disposed at the farthest position from a transfer roller 91 included in an after-described transfer portion 53, and in a direction toward the transfer roller 91, sequentially arranged are an image forming unit 51*y* for yellow, an image forming unit 51*m* for magenta, and an image forming unit 51*c* for cyan in this order.

The intermediate transfer body 52 is disposed above the image forming units 51 so as to be in contact with the photoreceptors 61. The intermediate transfer body 52 comprises a transfer belt 81, a transfer belt driving roller 82, a transfer belt driven roller 83, a transfer belt tension mechanism 84, and an intermediate transfer roller 85. Note that, regarding the intermediate transfer roller 85, four intermediate transfer rollers (85*k*, 85*y*, 85*m*, and 85*c*) are respectively provided so as to correspond to the image forming unit 51 for each color component. The intermediate transfer body 52 forms a full-color toner image on the transfer belt 81 by sequentially stacking on the transfer belt 81 toner images of respective color components formed on the photoreceptors 61 so that the toner images are transferred onto the transfer belt 81.

The transfer belt 81 is formed of a film with no end, having a thickness of around 75 μm to 120 μm. Materials of the transfer belt 81 preferably include polyimide, polycarbonate, or the like. In addition, the transfer belt 81 is stretched out between the transfer belt driving roller 82 and the transfer belt driven roller 83 so that an outer surface of the transfer belt 81 comes into contact with the outer peripheral faces of the photoreceptors 61, The transfer belt 81 is driven to rotate in a sub-scanning direction (in an arrow sign B direction in FIG. 3) by rotary driving force of the transfer belt driving roller 82 while tension is given to the transfer belt 81 by the transfer belt tension mechanism 84.

Inside the case 58 of the image forming apparatus 50, the transfer belt driving roller 82 is disposed closer to one end of the case 58. The transfer belt driving roller 82 is capable of driving the stretched-out transfer belt 81 to rotate in the arrow sing B direction. In addition, the transfer belt driving roller 82 is capable of conveying the recording paper while having the overlaid transfer belt 81 and recording paper sandwiched in pressure-contact between the transfer roller 91 of the transfer belt 53 and the transfer belt driving roller 82.

Inside the case 58, the transfer belt driven roller 83 is disposed closer to the other end of the case 58. The transfer belt driven roller 83 stretches the transfer belt 81 out in cooperation with the transfer belt driving roller 82.

Each of the intermediate transfer rollers 85 is provided in contact with the inner peripheral face of the transfer belt 81, and in contact with the photoreceptor 61 via the transfer belt 81. The intermediate transfer roller 85 is provided with a shaft formed of metal (for instance, stainless steel) having a diameter of 8 to 10 mm. An outer peripheral face of the metal shaft is covered with conductive elastic materials such as ethylene-propylene rubber (EPDM) and urethane foam, with the result that the intermediate transfer roller 85 is formed. To the intermediate transfer roller 85 thus configured is applied a high-voltage transfer bias, that is a high voltage having a polarity (+) opposite to a charge polarity (−) of the toner, in order to transfer the toner image formed on the photoreceptor 61 onto the transfer belt 81 of the intermediate transfer body 52, so that the high voltage is uniformly applied to the transfer belt 81 by the elastic material. The toner images developed on the respective photoreceptors 61 in accordance with respective color components are sequentially transferred onto the transfer belt 81 by the intermediate transfer roller 85, and then stacked thereon so that a desirable image is formed.

The transfer portion 53 comprises the transfer roller 91. The transfer roller 91 faces the transfer belt driving roller 82 in schematic horizontal and parallel therewith The transfer roller 91 has a predetermined nip so as to come into pressure-contact with the transfer belt 81 attached to the transfer belt driving roller 82. To the transfer roller 91 is applied a voltage for transferring onto the recording paper the full-color toner image formed on the transfer belt 81, that is a high voltage having a polarity (+) opposite to the charge polarity (−) of the toner. Further, in order to constantly obtain the nip between the transfer belt 81 and the transfer roller 91, it is preferable that either one of the transfer belt driving roller 82 and the transfer roller 91 is formed of hard materials such as metal while the other one is formed of soft materials such as elastic rubber and foamable resin. Below the transfer belt driving roller 82 and the transfer roller 91 is provided a registration roller 92. The registration roller 92 conveys the recording paper to the transfer roller 91 so as to synchronizes a leading end of the recording paper supplied from the after-described feeding portion 55, with an end of the toner image on the transfer belt 81. The toner image formed on the transfer belt 81 is transferred by the high voltage applied to the transfer belt 91, onto the recording paper which is passing through the nip between the transfer belt 81 and the transfer roller 91.

Further, on the other side of the intermediate transfer body 52, that is closer to a position where the transfer belt driven roller 83 is disposed, is provided a transfer belt cleaning unit (hereinafter referred to as a transfer BCU 54) which is the transfer cleaning device 54. The BCU 54 comprises a transfer body cleaning blade 93, a toner storage portion 94, and the transfer body waste toner conveying device 95. The transfer body cleaning blade 93 is provided in contact with the transfer belt 81. The toner storage portion 94 having a box shape once stores a toner scrubbed off from the transfer belt 81 by the transfer body cleaning blade 93, namely the waste toner. The transfer body waste toner conveying device 95 is provided inside the toner storage portion 94 so as to convey the stored waste toner The transfer BCU 54 is disposed upstream of the image forming units 51 and downstream of the transfer portion 53, with respect to a rotation direction of the transfer belt 81 (the arrow sign B direction). Moreover, on the transfer BCU 54, a portion of the transfer body cleaning blade 93 in contact with the outer surface of the transfer belt 81 is supported by the transfer belt driven roller 83 via the transfer belt 81.

As describe above, the toner attached to the transfer belt 81 by contact with the photoreceptor 61, and/or the residual toner which has not completely been transferred onto the recording paper at the transfer portion 53 are removed and collected by the transfer BCU 54 in order to prevent color mixture of the toner from being generated at next step.

With reference to FIG. 4 will be described positioning of the photoreceptor 61 through the developer collecting device 1, and recovery of the waste toner through the photoreceptor waste toner conveying device 67 and the transfer body waste toner conveying device 95. The photoreceptor 61 provided for each color component is rotatably supported by inserting photoreceptor shafts 60*k*, 60*y*, 60*m*, and 60*c*, respectively, into photoreceptor shaft supporting holes 12*k*, 12*y*, 12*m*, and 12*c* formed on the positioning frame 4 of the developer collecting device 1. As described above, the positioning frame 4 is positioned by the case positioning members 11*a* and 11*b* so as to be mounted on the case 58 and therefore, each of the photoreceptors 61 is positioned by inserting the photoreceptor shafts 60*k*, 60*y*, 60*m*, and 60*c* into the photoreceptor shaft supporting holes 12*k*, 12*y*, 12*m*, and 12*c* formed at predetermined positions on the positioning frame 4.

The photoreceptor waste toner conveying devices 67 respectively comprise a toner conveying case 101 having a tubular shape; and a conveying screw member 102 rotatably provided inside the toner conveying case 101, which conveying screw member 102 has a rotary shaft and sequential protrusions spirally extending in a direction of the rotary shaft. One end portion of the photoreceptor waste toner conveying device 67 protrudes more to the operation side of the image forming apparatus 50 than the mounting face 40 of the positioning frame 4 in the case 58. When mounting the positioning frame 4 on the image forming apparatus 50, the protruded portion is inserted into the waste developer recovery port 13 of the positioning frame 4 for positioning thereof.

The conveying screw member 102 of the photoreceptor waste toner conveying device 67 is driven to rotate by a driving source (not shown). By rotation of the conveying screw member 102, the waste toner, which has been scrubbed off from the surface of the photoreceptor 61 by the cleaning blade 66 and then stored inside the toner conveying case 101, is conveyed to the waste developer recovery port 13 of the positioning frame 4 The waste toner conveyed to the waste developer recovery port 13 passes through the waste developer passing hole 15, and then through the waste developer passage 14, so as to be collected in the waste developer container 2.

The transfer body waste toner conveying device 95 is also configured similarly to the photoreceptor waste toner conveying device 67. The photoreceptor waste toner conveying device 67 comprises a transfer body waste toner conveying case 103 having a tubular shape; and a transfer body waste toner conveying screw member 104 rotatably provided inside the transfer body waste toner conveying case 103, which transfer body waste toner conveying screw member 104 has a rotary shaft and sequential protrusions spirally extending in a direction of the rotary shaft. One end portion of the transfer body waste toner conveying device 95 protrudes more to the operation side of the image forming apparatus 50 than the mounting face 40 of the positioning frame 4 in the case 58. When mounting the positioning frame 4 on the image forming apparatus 50, the protruded portion is inserted into the waste developer recovery port 13 of the positioning frame 4 for positioning thereof.

In the transfer body waste toner conveying device 95, the following operation is carried out as in the case of the photoreceptor waste toner conveying device 67. By rotation of the transfer body waste toner conveying screw member 104 of the transfer body waste toner conveying device 95, the waste toner, which has been scrubbed off from the surface of the transfer belt 81 by the transfer body cleaning blade 93 and then stored inside the transfer body waste toner conveying case 103, is conveyed to the waste developer recovery port 13*e* of the positioning frame 4. The waste toner conveyed to the waste developer recovery port 13*e* passes through the waste developer passing hole 15*e*, and then through the waste developer passage 14*e*, so as to be collected in the waste developer container 2.

With reference back to FIG. 3 again, the recording paper, onto which the toner image has been totally transferred at the transfer portion 53, is subjected to fixing treatment at the fixing portion 56. The fixing portion 56 is disposed above the transfer portion 53. The fixing portion 56 comprises a pair of fixing rollers of a heating roller 105 and a pressure roller 106; and a conveying roller 107 disposed above the fixing rollers. The recording paper, onto which the toner image has been transferred, is conveyed from a lower side to an upper side of the fixing rollers. The toner image is fixed to the recording paper at the fixing portion 56 as follows. A fixing temperature is kept to a predetermined level by controlling heating means (not shown) such as a heater lamp provided inside or closer to the heating roller 105, on the basis of a detected value through a temperature detector. The recording paper, onto which the toner image has been transferred, is sandwiched between the heating roller 105 and the pressure roller 106 which rotate so as to convey the recording paper while heating and pressurizing the recording paper.

Above the fixing portion 56 is provided a discharging roller 108. The recording paper, which has been conveyed by the conveying roller 107, is discharged by the discharging roller 108 onto a catch tray which is the discharging portion 57.

Furthermore, a duplex document conveying path S3 for duplex printing is provided adjacent to the fixing portion 56. The duplex document conveying path S3 is formed from a back side of the fixing portion 56, toward a lower side of the fixing portion 56, down to a vicinity of the feeding portion 55. Through the duplex document conveying path S3, the recording paper in an inverted state is conveyed back again toward the transfer roller 91 by a pair of first conveying rollers 109 and a pair of second conveying rollers 110 each of which pair is arranged along the conveying path. In more detail, the first conveying rollers 109 are disposed behind the fixing portion 56 while the second conveying rollers 110 are located below the first conveying rollers 109. The second conveying rollers 110 are disposed at a horizontal position schematically identical to that of the registration roller 92.

Next, the feeding portion 55 for supplying the recording paper to the transfer portion 53 will be described. The feeding portion 55 is provided below the image forming units 51, The feeding portion 55 comprises a manual tray 111 and a feeding cassette 112 for storing the recording papers to be used for image information. The feeding portion 55 supplies the recording papers sheet by sheet from the manual tray 111 and the feeding cassette 112.

The manual tray 111 is provided on one side portion of the case 58 of the image forming apparatus 50 so that the manual tray 111 can be expansively opened outward when used, and housed in the one side portion when not used. Only a small number (necessary number) of recording papers of which type the operator desires, are placed on the manual tray 111 so that the recording papers are taken sheet by sheet into the case 58 of the image forming apparatus 50. Below the exposure unit 70, a pickup roller 113 is provided downstream of a feeding direction (an arrow sign C direction in FIG. 3) of the recording paper through the manual tray 111. Further downstream of the feeding (C) direction, a third conveying roller 114, a fourth conveying roller 115, and a fifth conveying roller 116 are provided.

The pickup roller 113 is in contact with a surface on the one end portion of the recording paper fed from the manual tray 111, and reliably conveys the recording papers sheet by sheet, using friction resistance of the roller. The fifth conveying roller 116 on the lowest stream in the feeding direction is provided above the third conveying roller 114 and the fourth conveying roller 115, with the result that the recording paper can be conveyed upward. The pickup roller 113, the third conveying roller 114, the fourth conveying roller 115, and the fifth conveying roller 116 constitute a recording paper conveying path S1.

Meanwhile, the feeding cassette 112 is provided below the image forming units 51 inside the case 58 and the exposure unit 70. The feeding cassette 112 is capable of accommodating a large amount of recording paper sheets of which size is set in a specification of an apparatus or predetermined by the operator Above one end portion of the feeding cassette 112 is provided another pickup roller 117. Downstream of a recording paper conveying direction (an arrow sign D direction in FIG. 3) of the pickup roller 117, a sixth conveying roller 118 is provided obliquely above the another pickup roller 117, The another pickup roller 117 is in contact with a surface on one end portion of recording paper situated at the uppermost portion of the recording papers set on the feeding cassette 112, so as to convey the recording papers by bringing out the recording papers reliably sheet by sheet using the friction resistance of the roller. The sixth conveying roller 118 conveys to the transfer portion 53 the recording paper, which has been brought out from the another pickup roller 117, upward along a recording paper conveying path S2 formed closer to one end portion inside the case 58.

Hereinafter will be described an image forming operation through the image forming apparatus 50 according to the embodiment.

At the outset, the outer peripheral face of the photoreceptor 61 is uniformly charged to a predetermined potential by the charger 62. By irradiating the charged photoreceptor 61 with a laser light from the exposure unit 70 which laser light is in accordance with image information, an electrostatic latent image for each color component is produced on each of the photoreceptors 61. Next, a toner as developer is supplied from the developer portion 64 to the outer peripheral face of the photoreceptor 61, so that the electrostatic latent image formed on the outer peripheral face of the photoreceptor 61 is developed by the toner to form a toner image.

The toner images for respective color components formed on the photoreceptors 61 are sequentially stacked and transferred onto the transfer belt 81 of the intermediate transfer body 52 by the intermediate transfer roller 85, so that a full-color toner image will be formed. The full-color toner image transferred onto the transfer belt 81 is totally transferred onto the recording paper by applying at the transfer roller 91 the transfer bias to the recording paper supplied from the manual tray 111 or the feeding cassette 112 of the feeding portion 55, when the transfer belt 81 has moved to the transfer portion 53.

The recording paper onto which the toner image has been transferred is conveyed to the fixing portion 56 where the toner image is fixed by heat onto the recording paper. The recording paper onto which the toner image has been transferred is, in a case of one-side printing request, discharged face down onto the discharging portion 57 by the discharging roller 108.

On the other hand, in a case of a duplex printing request, the recording paper is held by the discharging roller 108 and then, the discharging roller 108 is made to rotate in a reverse direction so that the recording paper is led to the duplex document conveying path S3 and conveyed again to the registration roller 92.by the first conveying roller 109 and the second conveying roller 110. At the time, compared to the former operation, an opposite face of the recording paper is treated with transferring while the recording paper is conveyed in a changed cross direction. In other words, a leading end of the recording paper during a first transfer becomes a tail end thereof during a rear face transfer while a tail end of the recording paper during the first transfer becomes a leading end thereof during the rear face transfer Onto the rear face of the recording paper is transferred the toner image. After the toner image is fixed by heat onto the recording paper, the recording paper is discharged onto the discharging portion 57 by the discharging roller 108.

As described above, a series of the image forming operations onto the recording paper are carried out.

In this image forming process, the residual toner on the surface of the photoreceptor 61 and the residual toner on the surface of the transfer belt 81 are removed by the photoreceptor cleaning device 65 and the transfer body cleaning device (transfer BCU) 54. The residual toners removed from the surface of the photoreceptor 61 and the surface of the transfer belt 81 are conveyed to the developer collecting device 1 by the photoreceptor waste toner conveying device 67 and the transfer body waste toner conveying device 95, and collected in the waste developer container 2 of the developer collecting device 1.

In the image forming device 50, when the waste developer container 2 of the developer collecting device 1 is not mounted on the positioning frame 4, the waste toner, which has been cleaned by the photoreceptor cleaning device 65 and the transfer BCU 54 and transferred by the photoreceptor waste toner conveying device 67 and the transfer body waste toner conveying device 95, is not accommodated in the waste developer container 2, but dispersed to pollute inside of the case 58 and to significantly decrease a quality of to-be-formed image. Accordingly, an operation for promoting the attachment of the waste developer container 2 is carried out.

Furthermore, even in a case where the waste developer container 2 of the developer collecting device 1 is mounted on the positioning frame 4, when the waste developer container 2 is filled up with the collected waste toner, the waste toner cleaned by the photoreceptor cleaning device 65 and the transfer BCU 54 will be dispersed inside the case 58, attributable to overflow thereof inside the photoreceptor waste toner conveying device 67 and the transfer body waste toner conveying device 95, or the apparatus will be damaged by excess load given thereon. Accordingly, in this case, the waste developer container 2 is replaced by an empty one, or an operation for promoting disposal of the waste developer in the waste developer container 2 is carried out.

Figure 11:
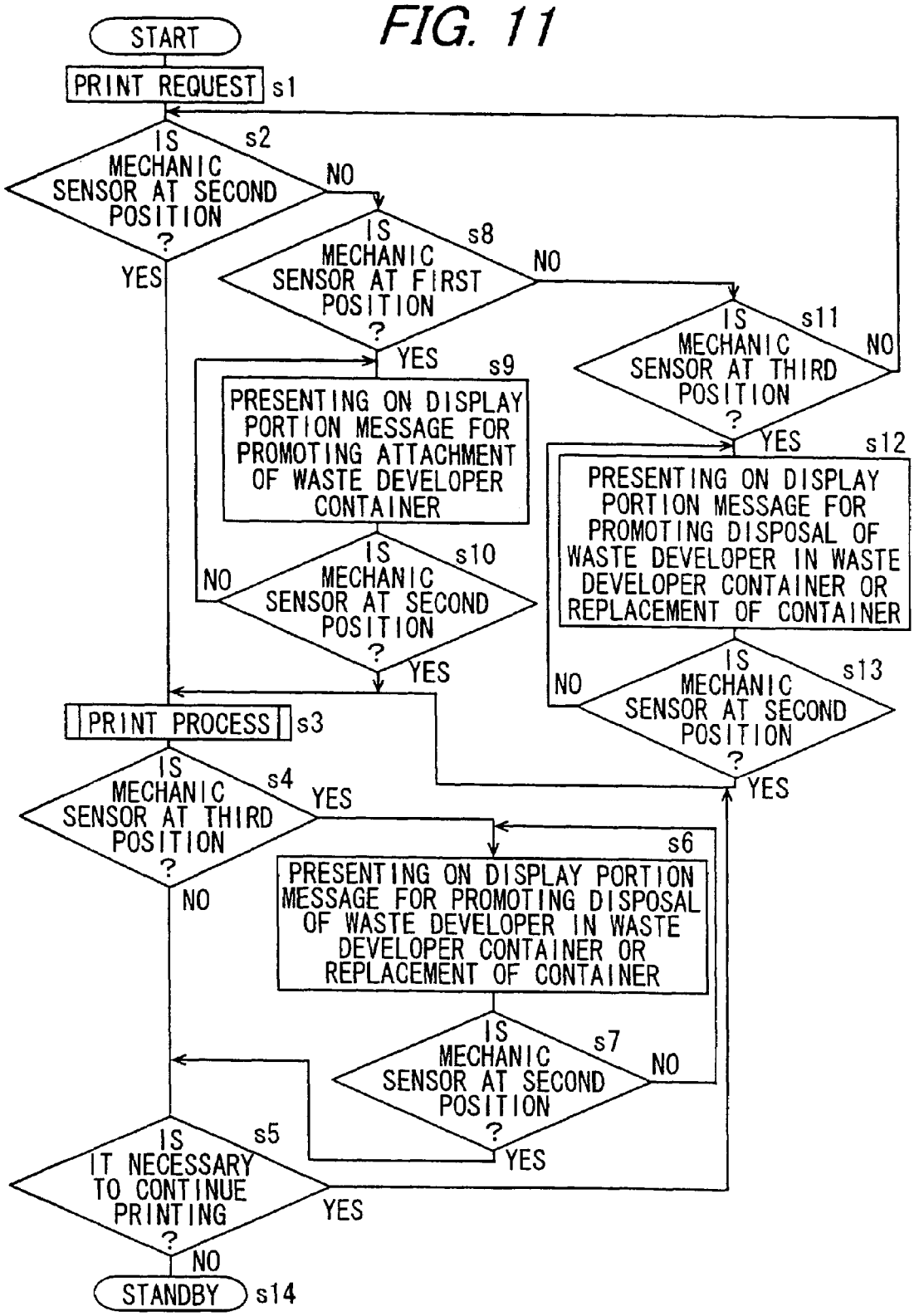
FIG. 11 is a flow chart of assistance in explaining control on an image forming operation in the image forming apparatus.

FIG. 11 is a flow chart of assistance in explaining control on the image forming operation in the image forming apparatus 50. In FIG. 11 will be described an operational control of the control section regarding whether or not the image formation (printing) is carried out or whether or not the above-mentioned operation for promoting the attachment of the container, the replacement of the container, or the disposal of the waste toner is carried out, in accordance with a detected result indicating whether or not the waste developer container 2 is mounted on the positioning frame 4 and whether or not the waste developer container 2 is filled up with the waste toner, in other words, in accordance with the relative position, namely at the first position, the second position, or the third position, of the sensor arm portion 32 of the mechanical sensor portion 23 provided in the container detection section 3 with respect to the sensor main body 31.

At start of the flow chart, a power source of the image forming apparatus 50 is turned on so that a start-up of initial state is completed. At the time, the image forming apparatus 50 is in a standby state waiting a print request from the operator.

At step s1, the operator inputs the print request, serving as a command signal for initiating the printing operation, from an operating portion of the image forming apparatus 50. At step s2, the control section determines whether or not the sensor arm portion 32 of the mechanical sensor 23 is situated at the second position (hereinafter will be simply referred to as a position of the mechanical sensor portion 23) on the basis of a detected output from the mechanical sensor portion 23 of the container detection section 3. Note that the control section is realized by a microcomputer including a central processing unit (CPU), for instance, which is mounted for controlling the entire printing operation of the image forming apparatus 50. When the mechanical sensor portion 23 is situated at the second position, in other words, when the waste developer container 2 is mounted on the positioning frame 4 and an accommodation capacity of the waste toner in the waste developer container 2 is not full, a step s3 proceeds. At step s3, a print process is carried out.

After the print process, a step s4 proceeds At step s4, it is determined whether or not the mechanical sensor portion 23 is situated at the third position, in other words, whether or not the waste developer container 2 is full. More specifically, since the print process has been carried out, the generated waste toner is collected by the developer collecting device 1 and accommodated in the waste developer container 2, and therefore it is determined whether or not the waste developer container 2 is full. When the mechanical sensor portion 23 is not situated at the third position but remains at the second position, the operation proceeds to a step s5 for determining whether or not it is necessary to continue printing. When it is not necessary to continue printing, step s14 proceeds to return to the standby state waiting for input of next print request. In contrast, when it is necessary to continue printing, the operation is returned to the step s3 and the following steps are repeated.

At the former step s4, when the mechanical sensor portion 23 is situated at the third position, in other words, when the waste developer container 2 is filled up with the waste toner, step s6 proceeds. At step s6, the control section presents a message on a display portion provided on the operating portion of the image forming apparatus 50 which display portion is composed of liquid crystal display (LCD) or the like. The message aims to promote the disposal of the waste toner in the waste developer container 2 or the replacement of the waste developer container 2 with an empty one.

At step s7, it is determined whether or not the mechanical sensor portion 23 is situated at the second position. Specifically, as a result of display at step s6, when the operator takes an action to dispose the waste toner in the waste developer container 2 or to replace the waste developer container 2 with an empty one, the mechanical sensor portion 23 is brought to the second position, and when the operator takes no actions, the mechanical sensor portion 23 is not brought to the second position. When the mechanical sensor portion 23 is situated at the second position, the step s5 proceeds and the following steps are carried out. When the mechanical sensor portion 23 is not situated at the second position, the operation is returned to the step s6 and the following steps are repeated.

At the former step s2, when the determination is negative and the mechanical sensor portion 23 is not situated at the second position, a step s8 proceeds. At step s8, it is determined whether or not the mechanical sensor portion 23 is situated at the first position, in other words, whether or not the waste developer container 2 is mounted on the positioning frame 4. When a determined result is positive and the waste developer container 2 is not mounted on the positioning frame 4, a step s9 proceeds.

At step s9, the message for promoting the attachment of the waste developer container 2 is presented on the display portion. At step s10, as a result of whether or not the mechanical sensor portion 23 is situated at the second position, namely as a result of display at step s9, when the operator takes an action of mounting an empty waste developer container 2, the mechanical sensor portion 23 is brought to the second position, and when the operator takes no actions, the mechanical sensor portion 23 is not brought to the second position. When the mechanical sensor portion 23 is situated at the second position, the step s3 proceeds and the following steps are carried out. When the mechanical sensor portion 23 is not situated at the second position, the operation is returned to the step s9 and the following steps are repeated.

When the determination at step s8 is negative and the mechanical sensor portion 23 is not situated at the first position, a step s11 proceeds. At step s11, it is determined whether or not the mechanical sensor portion 23 is situated at the third position, in other words, whether or not the waste developer container 2 is filled up with the collected waste toner. When a determined result is positive and the waste developer container 2 is filled up with the collected waste toner, a step s12 proceeds. At step s12, the display portion presents a message for promoting the disposal of the waste toner in the waste developer container 2 or the replacement of the waste developer container 2 with an empty one.

At step s13, it is determined whether or not the mechanical sensor portion 23 is situated at the second position. Specifically, as a result of display at step s12, when the operator takes an action to dispose the waste toner in the waste developer container 2 or to replace the waste developer container 2 with an empty one, the mechanical sensor portion 23 is brought to the second position, and when the operator takes no actions, the mechanical sensor portion 23 is not brought to the second position. When the mechanical sensor portion 23 is situated at the second position, the step s3 proceeds and the following steps are carried out. When the mechanical sensor portion 23 is not situated at the second position, the operation is returned to the step s12 and the following steps are repeated.

When the determination at the former step s11 is negative and the mechanical sensor portion 23 is not situated at the third position, specifically when the waste developer container 2 is mounted on the positioning frame 4 and not filled up with the waste toner, the operation is returned to the step s2 and the following steps proceed.

As described above, in the image forming apparatus 50, the control section carries out the operational control in accordance with detected results of whether or not the waste developer container 2 is mounted on the positioning frame 4, and of whether or not the waste developer container 2 is filled up with the waste toner. Accordingly, it becomes possible to prevent troubles attributable to the waste toner from generating.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developer collecting device which collects residual developer cleaned away through a transfer body, on which the residual developer remains without being transferred when a developer image formed in an image forming unit is transferred on the transfer body, by a cleaning section, comprising:

a positioning frame arranged to determine a mounting position of the image bearing member onto an image forming apparatus main body;

a waste developer container detachably mounted on the positioning frame and arranged to accommodate the waste developer removed by the cleaning section; and an integrated container detection section including a mechanical sensor portion arranged to detect whether or not the waste developer container is mounted on the positioning frame and arranged to detect whether or not the waste developer container is filled up with the waste developer, the mechanical sensor portion including a sensor arm portion arranged to be in one of three positions, a first position indicating that the waste developer container is not mounted, a second position indicating that the waste developer container is mounted and not filled with the waste developer, and a third position indicating that the waste developer container is mounted and filled with the waste developer, wherein the waste developer container includes a waste developer stirring shaft rotatably provided therein arranged to stir the waste developer accommodated therein, and wherein the integrated container detection section is provided on a prolonged part of the waste developer stirring shaft which part is located on an outer side portion of the waste developer container mounted on the positioning frame.

2. The developer collecting device of claim 1, wherein the integrated container detection section comprises a rotary driving section;

a driving coupling member coupled with the rotary driving section; and a driving arm portion mounted on the driving coupling member so as to rotate, the driving arm portion having an engaging convex portion formed thereon, and wherein an engaging concave portion is formed on one end portion in an axial direction of the waste developer stirring shaft which one end portion faces the integrated container detection section, and wherein by an engagement of the engaging convex portion with the engaging concave portion, a rotary driving force of the rotary driving section is transmitted to the waste developer stirring shaft.

3. The developer collecting device of claim 2, wherein the connecting member includes a spring member for biasing the connecting member against the driving coupling member.

4. An image forming apparatus provided with the developer collecting device of claim 1.

5. An integrated container detection section integrated with a developer collecting device of an image forming apparatus, comprising:

a mechanical sensor arranged to detect whether or not a waste developer container is mounted on a positioning frame of an image forming apparatus and arranged to detect whether or not the waste developer container is filled up with waste developer, the mechanical sensor portion including a sensor arm portion arranged to be in one of three positions, a first position indicating that the waste developer container is not mounted, a second position indicating that the waste developer container is mounted and not filled with the waste developer, and a third position indicating that the waste developer container is mounted and filled with the waste developer;

a movable lever arranged to be angularly displaceable about a supporting shaft; and a connecting member arranged to couple with a waste developer stirring shaft of the developer collecting device, the connecting member being movable in an axial direction according to a level of a rotational load of the waste developer stirring shaft, wherein the mechanical sensor is arranged to detect whether or not the waste developer container is mounted on the positioning frame in accordance with a position of the movable lever moving an angular displacement position thereof by attachment and detachment of the waste developer container with respect to the positioning frame, and wherein the mechanical sensor is arranged to detect whether or not the waste developer container is filled with the waste developer in accordance with a position in the axial direction of the connecting member moving in reference to the level of rotational load of the waste developer stirring shaft.

6. The integrated container detection section of claim 5, wherein the mechanical sensor portion comprises:

a sensor main body portion integrally configured with the movable lever such that an angular displacement of the movable lever causes a corresponding displacement of the sensor main body portion;

wherein the sensor arm portion fitted within the sensor main body portion and arranged to be in one of the three positions relative to the sensor main body portion.

7. The integrated container detection section of claim 6, further comprising a bias spring member arranged to bias the connecting member axially in a directions such that the sensor arm portion is biased to be in the second position.

8. A method of using an integrated container detection section integrated with a developer collecting device of an image forming apparatus, the integrated container detection section including a mechanical sensor portion arranged to detect whether or not a waste developer container is mounted on a positioning frame of an image forming apparatus and arranged to detect whether or not the waste developer container is filled up with waste developer, the mechanical sensor portion including a sensor arm portion arranged to be in one of three positions, a first position indicating that the waste developer container is not mounted, a second position indicating that the waste developer container is mounted and not filled with the waste developer, and a third position indicating that the waste developer container is mounted and filled with the waste developer, the method comprising:

receiving a print request;

determining whether the sensor arm portion is initially in the second position;

processing the print request after determining that the sensor arm portion is initially in the second position;

determining whether the sensor arm position is in the third position after processing the print request;

displaying a message to dispose the waste developer in the waste developer container or to replace the waste developer container after determining that the sensor arm portion is in the third positions;

determining whether the sensor arm portion is in the first position after determining that the sensor arm portion is not initially in the second position; and displaying a message to attach the waste developer container to the image forming apparatus after determining that the sensor arm portion is in the first position after determining that the sensor arm portion is not initially in the second position.

9. The method of claim 8, further comprising:

determining whether the sensor portion is in the third position after determining that the sensor arm portion is not in the first position after determining that the sensor arm portion is not initially in the second position; and displaying the message to dispose the waste developer in the waste developer container or to replace the waste developer container after determining that the sensor arm portion is in the third position.

10. A developer collecting device which collects residual developer cleaned away through a transfer body, on which the residual developer remains without being transferred when a developer image formed in an image forming unit is transferred on the transfer body, by a cleaning section, comprising:

a positioning frame arranged to determine a mounting position of the image bearing member onto an image forming apparatus main body;

a waste developer container detachably mounted on the positioning frame and arranged to accommodate the waste developer removed by the cleaning section; and an integrated container detection section including a mechanical sensor portion arranged to detect whether or not the waste developer container is mounted on the positioning frame and arranged to detect whether or not the waste developer container is filled up with the waste developer, the mechanical sensor portion including a sensor arm portion arranged to be in one of three positions, a first position indicating that the waste developer container is not mounted, a second position indicating that the waste developer container is mounted and not filled with the waste developer, and a third position indicating that the waste developer container is mounted and filled with the waste developer, wherein the integrated container detection section comprises:

a movable lever angularly displaceable about a supporting shaft; and a connecting member coupled to the waste developer stirring shaft, the connecting member being movable in an axial direction according to a level of rotational load of the waste developer stirring shaft, and wherein the integrated container detection section is arranged to detect:

whether or not the waste developer container is mounted on the positioning frame in accordance with a position of the movable lever moving an angular displacement position thereof by attachment and detachment of the waste developer container with respect to the positioning frame; and whether or not the waste developer container is filled up with the waste developer in accordance with a position in the axial direction of the connecting member moving in reference to the level of rotational load of the waste developer stirring shaft.

11. An image forming apparatus provided with the developer collecting device of claim 10.

12. The developer collecting device of claim 10, wherein the first and second positions are determined in accordance with the angular displacement position of the movable lever about the supporting shaft, and the third position is determined in accordance with a movement position in the axial direction of the connecting member.

13. The developer collecting device of claim 12, wherein, in the integrated container detection section, the connecting member is arranged to couple with the driving coupling member by moving in a rotational axis line direction toward the waste developer container when a rotational load of the waste developer stirring shaft is small, and the connecting member is arranged to detach from the driving coupling member by moving in the rotational axis line direction away from the waste developer container when the rotational load of the waste developer stirring shaft is large, whereby the integrated container detection section is arranged to detect the third position and thereby detect that the waste developer container is filled up with the waste developer.

* * * * *